US006418841B1

(12) United States Patent
Little et al.

(10) Patent No.: US 6,418,841 B1
(45) Date of Patent: Jul. 16, 2002

(54) SYSTEM AND METHOD FOR COMPACTING AND TRANSPORTING SCRAP METAL

(75) Inventors: Jonathan A. Little, Kalamazoo; Donald R. Schomisch, Allegan, both of MI (US)

(73) Assignee: PMDS, LLC, Oxford, MI (US)

( * ) Notice: Subject to any disclaimer, the term of this patent is extended or adjusted under 35 U.S.C. 154(b) by 0 days.

(21) Appl. No.: 09/444,088

(22) Filed: Nov. 22, 1999

(51) Int. Cl.[7] ..... B30B 15/26; B30B 15/30

(52) U.S. Cl. ..... 100/43; 100/45; 100/48; 100/49; 100/229 A

(58) Field of Search ..... 100/43, 45, 48, 100/49, 99, 229 A; 177/141

(56) References Cited

U.S. PATENT DOCUMENTS

| | | | | |
|---|---|---|---|---|
| 3,059,789 A | | 10/1962 | Bowles | |
| 3,231,107 A | | 1/1966 | Clar | |
| 3,472,329 A | | 10/1969 | Smith | |
| 3,647,098 A | | 3/1972 | Smith | |
| 3,724,713 A | | 4/1973 | Coren | |
| 3,799,374 A | | 3/1974 | Weaver | |
| 3,848,797 A | | 11/1974 | Kolling | |
| 3,895,681 A | | 7/1975 | Griffin et al. | |
| 3,999,621 A | | 12/1976 | Wagner | |
| 4,102,262 A | | 7/1978 | Liberman et al. | |
| 4,147,264 A | | 4/1979 | Harvey et al. | |
| 4,203,497 A | | 5/1980 | Harris et al. | |
| 4,271,756 A | | 6/1981 | Bettencourt | |
| 4,557,658 A | | 12/1985 | Lutz | |
| 4,569,407 A | | 2/1986 | Gray et al. | |
| 4,627,507 A | | 12/1986 | Powell et al. | |
| 4,714,121 A | | 12/1987 | Kroll et al. | |
| 5,170,906 A | | 12/1992 | Kochelek | |
| 5,173,866 A | * | 12/1992 | Neumann et al. | 100/229 A |
| 5,214,594 A | * | 5/1993 | Tyler et al. | 100/229 A |
| 5,299,142 A | * | 3/1994 | Brown et al. | 100/229 A |
| 5,303,642 A | * | 4/1994 | Durbin et al. | 100/229 A |
| 5,558,013 A | * | 9/1996 | Blackstone, Jr. | 100/229 A |
| 5,789,714 A | * | 8/1998 | Doerksen | 177/141 |
| 5,967,028 A | | 10/1999 | Schomisch et al. | |
| 6,003,441 A | * | 12/1999 | Little | 100/229 A |
| 6,138,557 A | * | 10/2000 | Brown et al. | 100/99 |
| 6,177,638 B1 | | 1/2001 | Murray | |

FOREIGN PATENT DOCUMENTS

| | | |
|---|---|---|
| DE | 2 155 760 | 5/1973 |
| GB | 2 087 791 | 6/1982 |

* cited by examiner

*Primary Examiner*—Stephen F. Gerrity
*Assistant Examiner*—Louis Huynh
(74) *Attorney, Agent, or Firm*—Flynn, Thiel, Boutell & Tanis, P.C.

(57) ABSTRACT

A system and method for compressing scrap metal. The scrap metal is compressed in a portable container. The container rests on two scales that rest above the ground surface. The fullness of the container is primarily evaluated based on the weight of the container. The scrap metal is initially delivered to a static compactor to which the container is mated. The compactor includes a ram that forces the scrap metal into and compresses the scrap metal in the container. The weight of the container is continually monitored while the container is mated to the compactor. The actuation of the ram is controlled so that, as the amount of scrap metal in the container increases, the frequency with which the ram is actuated increases. After the volume of scrap metal in the container increases above a certain level, each actuation of the ram actual comprises running the ram through plural extension and retraction cycles. The weight of the container is employed as the primary variable upon which the fullness of the ram is evaluated. The pressure of the hydraulic fluid that actuates the ram is also monitored. Even if the container weight is below a set weight, if the hydraulic pressure exceeds a set pressure, the container is considered full.

37 Claims, 19 Drawing Sheets

SYSTEM AND METHOD FOR COMPACTING AND TRANSPORTING SCRAP METAL

FIELD OF THE INVENTION

This invention is generally related to solid waste handling. More particularly, this invention is related to a system and method that improves the efficiency of transporting waste material such as scrap metal.

BACKGROUND OF THE INVENTION

One of the byproducts of a metal shaping process is the generation of scrap metal. These scrap metal pieces are the remnants of the workpiece that are cut or punched away from the workpiece as it is shaped to formed the desired end product. Some metal processing facilities, such as those that produce automobile/truck parts or parts for other high volume products, produce large amounts of this scrap metal. This scrap metal is collected and shipped to a recycling facility where it is used as feed stock to form new metal.

Often, this scrap metal is shipped from the location at which it is generated to the recycling facility in large open-topped truck trailers. In this process, the scrap is simply discharged into these trailers from an overhead chute at the location at which it is generated. A disadvantage of this method of hauling the scrap is that one these trailers, though it may be approximately 38 feet in length, it can only hold approximately 20,000 pounds of scrap metal before it is completely full. Consequently, at a location where high volumes of scrap are generated, it is often necessary to frequently remove a trailer that is full of scrap and provide an empty replacement. The cartage costs associated with having to frequently remove these trailers accumulates. There have been attempts to increase the amount of scrap metal removed in each haul by compressing the metal. Specifically, there have been efforts to use conventional compactor systems to increase the amount of scrap metal that is can be loaded in a single trailer. This type of system includes a compactor and a complementary closed container; the container is closely mated to the compactor. The scrap metal is placed in the compactor. A ram integral with the compactor forces the metal into the container. As the container becomes full, the ram compresses the scrap metal in the container. Consequently, the containers integral with this type of system are able to be filled with more scrap metal than can be held in a comparably sized open-topped trailer.

However, there are limits to the amount to which scrap metal can be compressed using conventional compression systems and their complementary containers. One limitation is due to the fact that, as the metal fills the container, it surrounds the opening through which it is filled. When the ram is retracted out of the container, some of the waste becomes caught in the interstitial space between the top of the ram and the a adjacent opening-defining lip of the container. This scrap can wedge between the container and ram. If this occurs, the scrap blocks further retraction of the ram and the subsequent further filling of the container. In order to free the ram, manpower must be employed to remove the trapped metal.

Another problem with a scrap metal compression system is that it is necessary to ensure that the system does not overfill the container in which the scrap metal is compressed. If this occurs, the structural members forming the container may bend or break, rendering the container useless. In theory, it should be possible to simple measure container fullness by simply weighing the container as it is filled with scrap metal. However, these containers, when empty, weight a minimum of 22,000 pounds. As a container is filled with scrap metal, its gross weight can exceed 100,000 pounds. To date, the most convenient means of measuring this type of container as it is loaded is to place the container on a large pit scale. This type of scale includes a platform that is seated in a pit. in a pit that extends below the ground level. The platform has a ground-level surface on which the container is located. This type of scale works reasonably well. However, it is expensive to install.

There have been some attempts to provide above ground scales for measuring the weight of a filled scrap metal container. However, the platforms integral with these scales upon which these containers are seated cannot be positioned too far above the ground level. Consequently it has proven impractical to use the conventional above-ground scales to monitor the weight/fill state of a scrap metal container. Thus, given the expense associated with installing a pit scale and the impracticalities associated with using an above-ground scale, it has proven difficult to provide an economical means for measuring the weight of a container used to hold compressed scrap metal.

Also, there are some instances when gross container weight does not serve as an accurate measure of container fullness. This is because, depending on the product being produced, the weight-per-unit volume of the scrap metal may vary. For example, steel, per unit volume, is heaver than aluminum. At many metal forming facilities, different types of scrap metal may be forwarded to the same container. Given the differences in weight of these different materials, the gross container weight may not serve as an accurate measure of container fullness.

Moreover, once the scrap metal is placed in the container, it eventually needs to be unloaded. In a conventional open topped trailer, the unloading is relatively simple. The trailer is simply inclined so that gravity flows the scrap out of the container. However, it has not proven as easy to unload scrap metal from a closed container in which the metal is compressed. The compressed scrap metal appears to adhere to the internal surfaces of the container. When the container is inclined, gravity alone does not provide sufficient force for causing the scrap to unload from the container.

Consequently, at facilities where the scrap metal is compressed, the metal is often compressed into what is referred to as an "injection" container. An injection container is a closed container with a front wall that is capable of being moved toward the rear of the container. This movement is accomplished by applying a hydraulic force to move the wall. When the container is being filled, the wall is placed in its most forward position. At the unloading facility, a hydraulic pump integral with the container is actuated so as to force the wall rearward. The movement of the wall results in a like rearward movement of the compressed scrap metal out of the container. While injection containers work reasonably well, they are clearly more expensive to provide than conventional containers with fixed front walls. Moreover, providing the supplemental hardware and hydraulic equipment needed to facilitate the front wall of an injection container increases its empty weight by 12,000 pounds or more over a comparable-sized fixed-wall container. This increase in container weight reduces the net weight of the scrap the container is able to transport.

Thus, given the above limitations of current compacting systems, these system are generally not used to load more than 30,000 pounds of compressed scrap metal in a single container. Consequently, while use of these systems reduces the haulage costs associated with removing this material, these costs can still be appreciable.

SUMMARY OF THE INVENTION

This invention relates generally to a new and improved system and method for compacting and transporting material such as scrap metal. The system and method of this invention includes a compactor with members designed to eliminate the likelihood that the waste can become trapped and prevent the compactor's ram from retracting. The method by which the scrap metal is compressed further reduces the likelihood that the metal will wedge against the ram so as to block its retraction. The system and method of this invention also include a scale especially designed to weight the multi-ton containers in which heavy waste such as scrap metal is compacted. The scale of this invention is further designed to simply be placed on the ground surface of the location at which use of the scale is desired. The system and method of this invention also includes a container well suited to both hold scrap metal and transport it to an end location. More particularly, the container of this invention is designed to maximize the amount of material that can be compacted in it. The container is also designed so that when inclined, gravity provides sufficient force to cause the compressed material to flow out.

BRIEF DESCRIPTION OF THE DRAWINGS

The invention is pointed out with particularity in the claims. The above and further features and advantages of the invention may be better understood by reference to the following description taken in conjunction with the accompanying drawings, in which:

DETAILED DESCRIPTION

Figure 1:
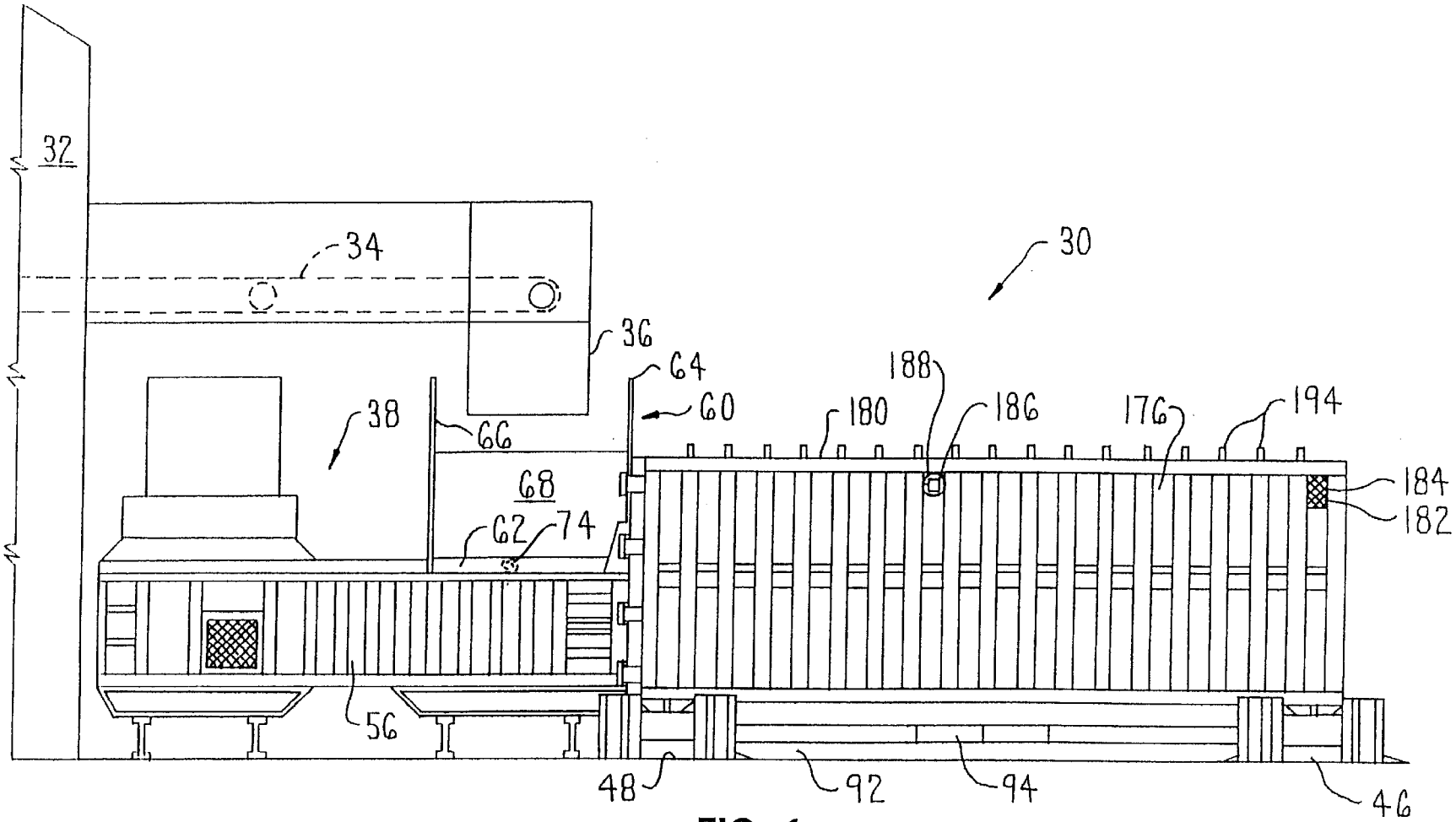
FIG. 1 is a side view of the material compacting system of this invention.
Figure 2:
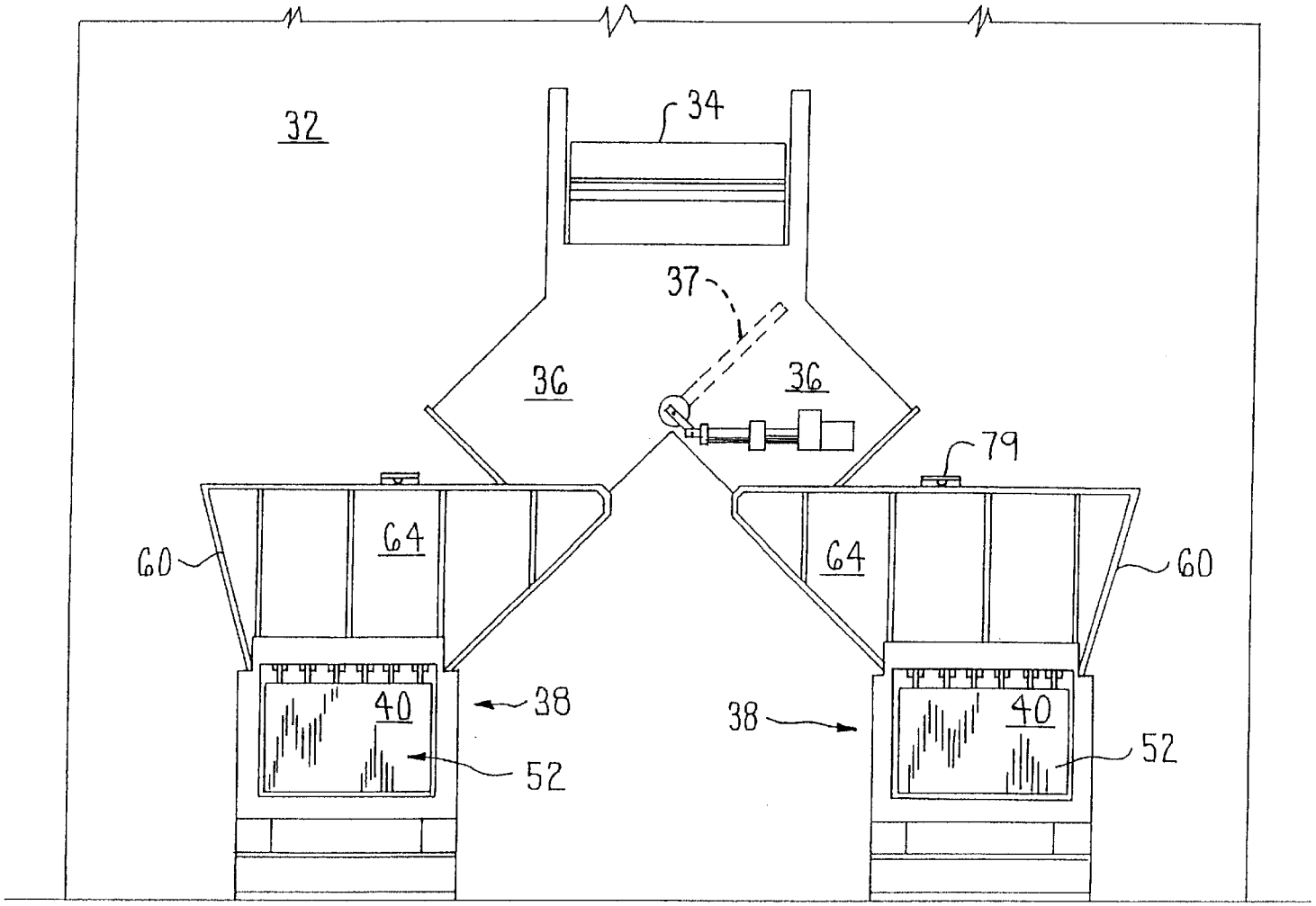
FIG. 2 is a front view depicting how, at an industrial facility, two compactors of the system of this invention may be arranged for sequential operation.
Figure 10:
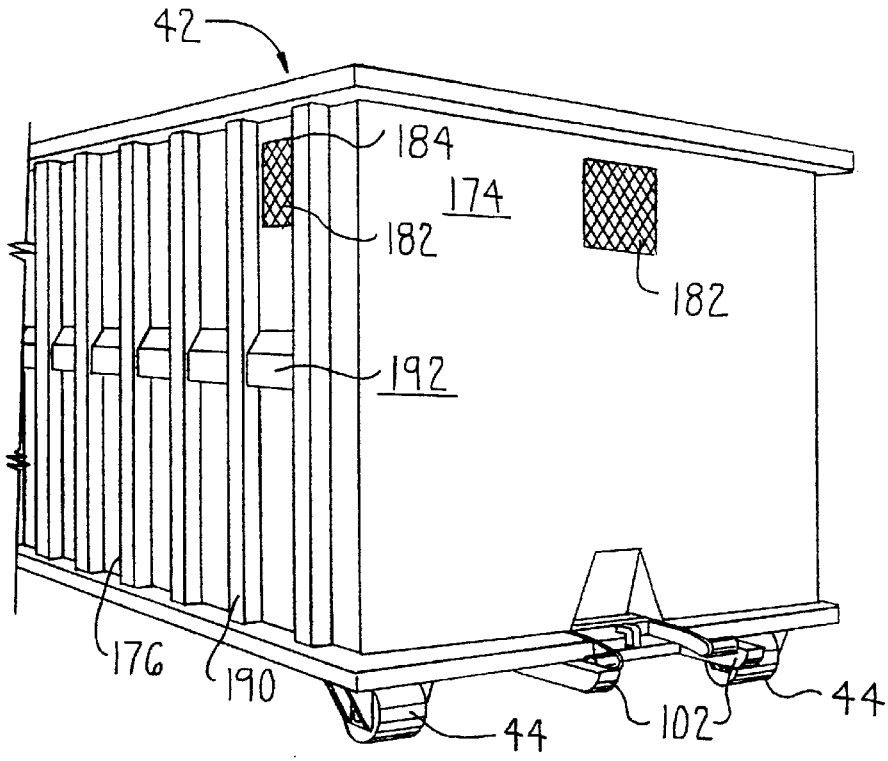
FIG. 10 is a perspective view of the front of a container.

FIGS. 1 and 2 illustrate a system 30 of this invention for compressing and transporting compressible material such as scrap metal. The system 30 is shown next to an industrial facility 32. At the facility 32, waste, namely scrap metal, is transported away from the location at which it is generated by a conveyor 34 and discharged from a chute 36. The system 30 includes a compactor 38 into which the waste is discharged. The compactor 38 includes a ram 40 that forces the waste into a container 42 mated to the compactor. Small steel wheels 44, (FIG. 10) approximately 9 inches in diameter, are mounted to the bottom of the container 42 provide the container with mobility. The container wheels 44 rest on front and rear scales 46 and 48, respectively. Collectively, scales 46 and 48 provide an indication of the weight of the container 42 and the material held therein. This weight data is used as an input variable for evaluating the extent to which the container is filled with compressed material.

At some facilities, two systems 30 of this invention are arranged side-by-side. The scrap metal is flowed from the conveyor 34 to one of the compactors 38 through one of two chutes 36 that extend away from the conveyor. A damper plate 37, t shown in phantom) integral with the chutes 36 controls through which chute the scrap metal is flows and into which of the two compactors 38 the material is discharged.

Figure 3:
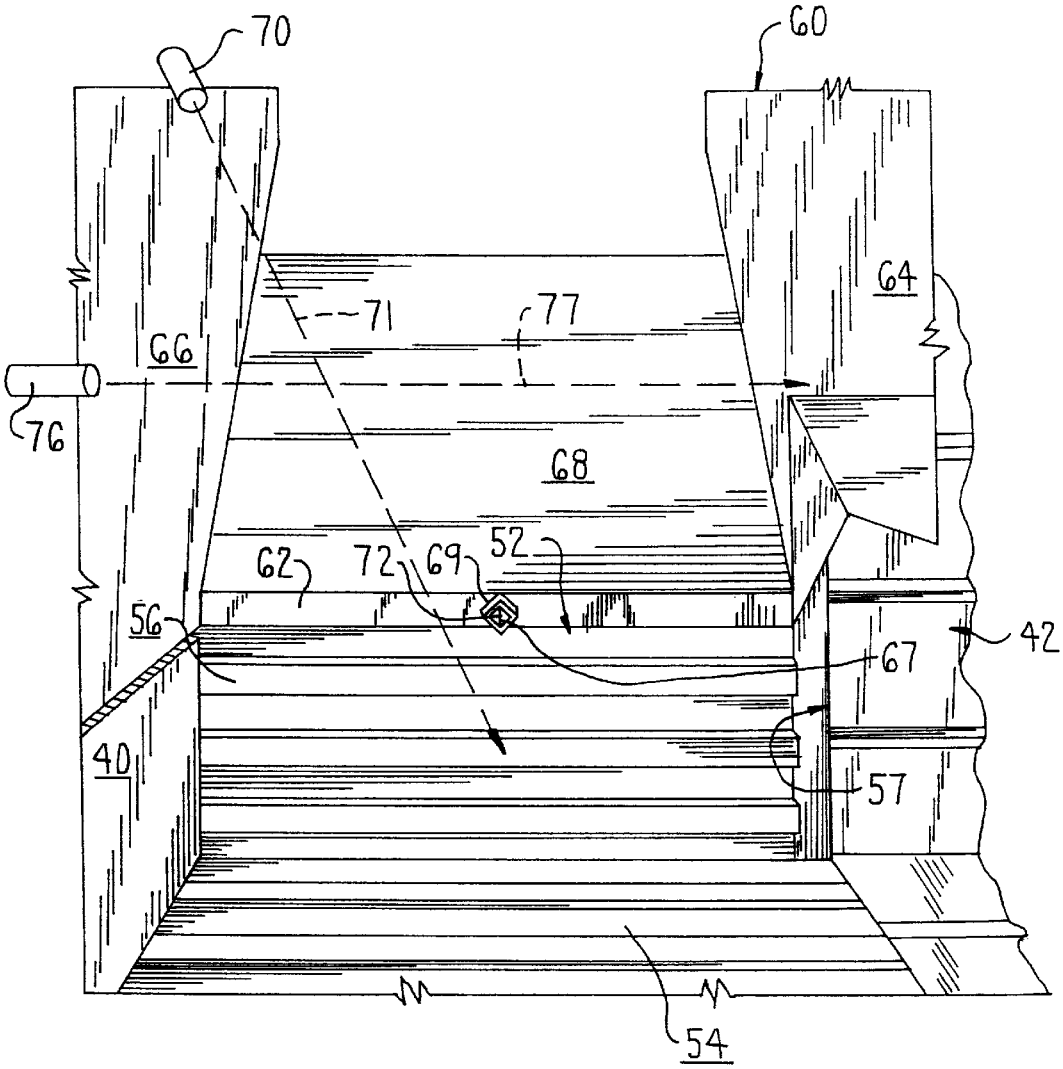
FIG. 3 is a perspective view of the charge chamber of a compactor.
Figure 4:
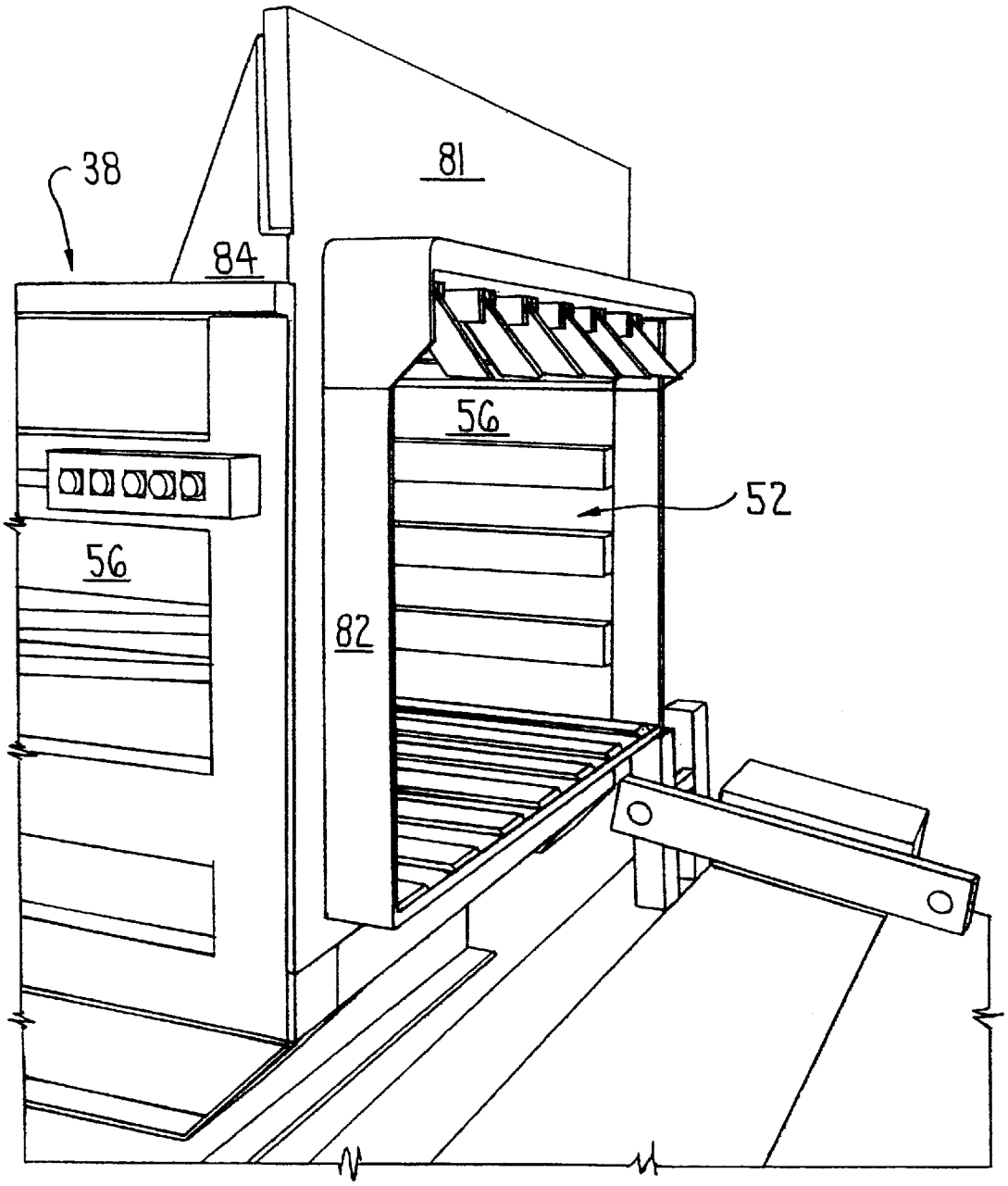
FIG. 4 is a front perspective view of the compactor with the hopper removed.

As seen in FIGS. 2–4, the front end of the compactor 38 is shaped to have a charge chamber 52 which is the space internal to the compactor into which the scrap metal is discharged. The charge chamber 52 is defined by a base plate 54 and two opposed side walls 56 of the compactor 38. The front end of the compactor 38, which is the front end of the charge chamber 52, is open. This open front end of the charge chamber is contiguous with a complementary opening 57 in the rear end of the container 42. A hopper 60 is positioned above and around the charge chamber 52 to direct the flow of material discharged from the chute 36 into the chamber. Hopper 60 includes a lip 62 which is seated in the open top end of the compactor 38 that defines the top of the charge chamber 52. Front and rear panels 64 and 66, respectively, extend vertically upwardly from opposed ends of lip 62. Opposed side panels 68 extend between the front and rear panels 64 and 66. Side panels 68 extend diagonally away from the opposed side portions of lip 62. Three sensors are mounted to the hopper 60 in order to provide an indication of the fill state of the charge chamber 52. A first one of the sensors is a reflecting-type electric eye unit 70 that is mounted to the top of the rear panel 66. Electric eye unit 70 directs a beam of light, represented by dashed arrow 71, diagonally towards the center of the charge chamber 52. Electric eye unit 70 measures the distance to a solid object as by how long it takes the emitted light to strike the object and reflect back to the eye.

Electric eye 70 is mounted in a housing 79 (FIG. 2) fitted to the top edge of the hopper rear panel 666. Housing 79 both holds electric eye in position and protects the eye from the elements.

Transmitting light beam unit 72 and complementary photosensor 74 are mounted in the hopper lip 62 and collectively form the second sensor. The light beam unit 72 and photosensor 74 are mounted to the outside of lip 62. The lip 62 is formed with opposed openings 67 through which the light beam generated by unit 72 travels from the unit to the photosensor 74. Collectively, the light beam unit 72 and photosensor 74 are aligned so that the beam of light emitted by unit is received by the photosensor 74. The light beam unit 72 and photosensor 74 are further mounted to the hopper lip 62 so that the light beam transits along a line immediately above the center of the charge chamber 52. A small diamond-shaped flange 69 extends inwardly from the lip 62 around each opening 67. The flanges 69 prevent material from entering the openings 67 and blocking the light beam.

A second distance measuring electric eye unit 76 is mounted in approximately the center of the hopper rear panel 66. The light beam generated by electric eye unit 76, represented by dashed arrow 77, is directed horizontally across the hopper 60 towards the opposed surface of the hopper front panel 64. Not depicted in the Figures is the housing in which electric eye unit 76 is mounted. This housing, which is mounted to the hopper rear panel 66, is similar in function to previously described housing 79. The hopper rear panel 66 is also formed with an opening, not identified, through which the light beam associated with electric eye 76 transits.

The compactor ram 40 is a solid block of steel.

Figure 20:
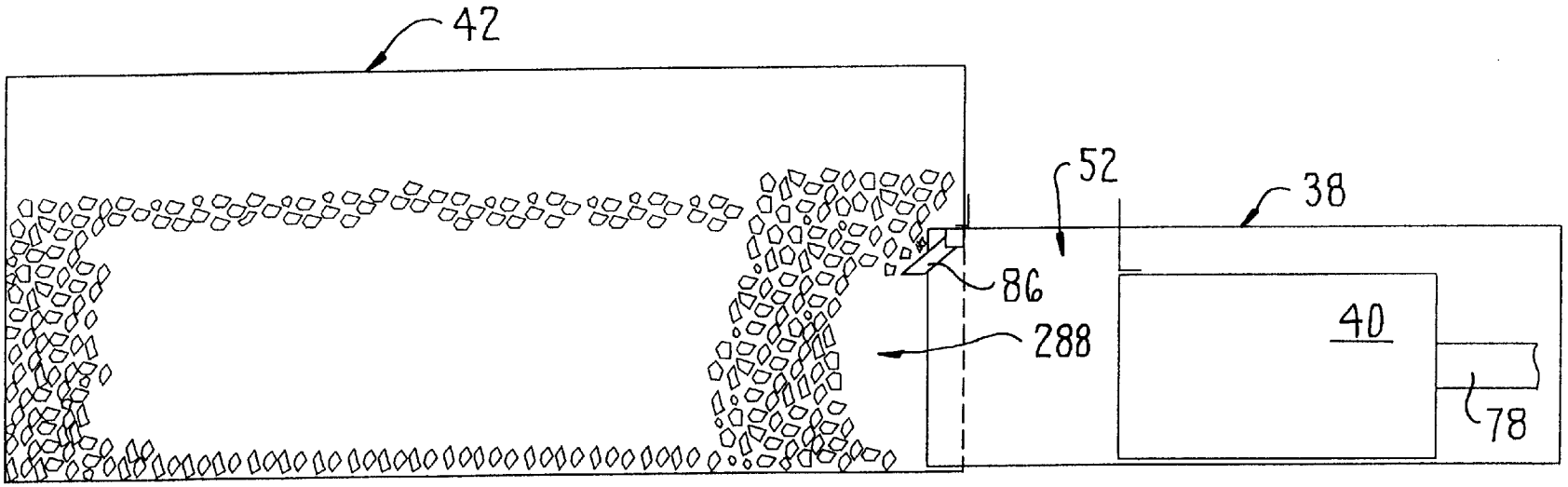
FIG. 20 is a view inside the container in which the state of the scrap metal after the completion of a supplemental extension and retraction cycle is depicted.

Normally, the ram 40 is located inside the body of the compactor 38, away from the charge chamber 52 (FIG. 20). The ram 40 is secured to the front end of a piston rod 78, depicted diagrammatically in FIG. 13. When the ram 40 is in the retracted state, piston rod 78 is located rearward of the charge chamber 52 in the enclosed rear half of the compactor 38. The piston rod 78 is encased in a static cylinder 80, housed in the rear half of the compactor 38. Hydraulic fluid is selectively applied to cylinder 80 in order to cause the extension and retraction of the piston rod 78 and the ram 40. One source for the basic compactor 38, including ram 40, and the hydraulic system that actuates the ram is the Marathon Equipment Company of Vernon, Ala.

Returning to FIG. 4, it can be seen that a plate, referred to as a breaker bar 81, located at the front end of the compactor 38. Breaker bar 81 extends between the compactor side walls 56. The breaker bar 81 is located above the open front end of the charge chamber 52. The breaker bar 81 is welded to two opposed rectangular support plates 84 that extend upwardly from the opposed compactor side walls 56. The breaker bar 81 functions as a stop plate for the container 42 when the container is backed against the front end of the compactor 38 (FIG. 5)

The front end of the compactor 52 is provided with a rectangular flange 82 surrounds the open front end of the charge chamber 52. The flange 82 is formed out of flat metal and extends horizontally forward from the front end of the compactor 52. Flange 82 functions as a male member that fits around and into the perimeter of the opening 57 in the rear of container 42 through which the scrape metal is loaded in the container.

Figure 5:
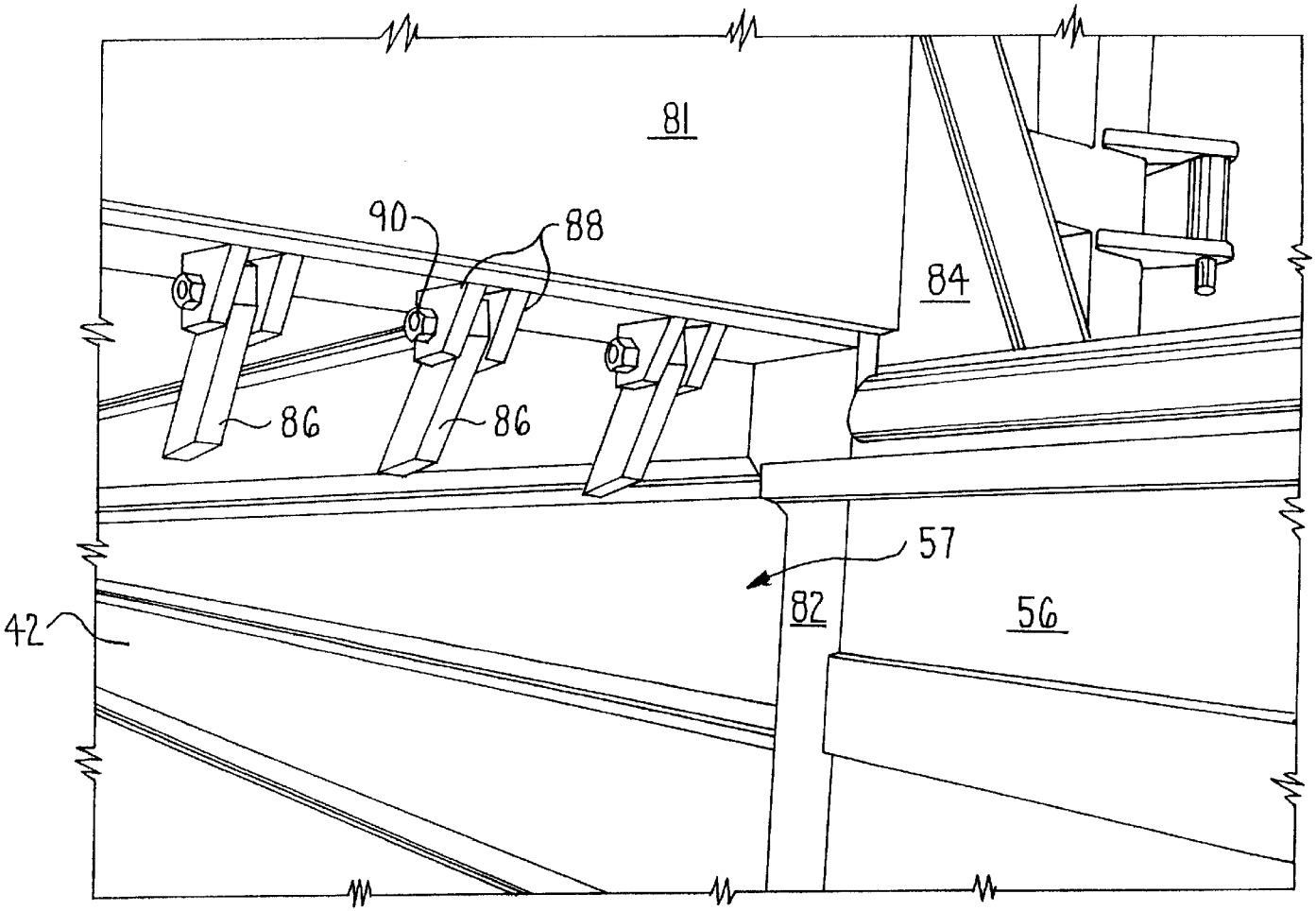
FIG. 5 depicts in detail the teeth of the compactor.

A set of teeth 86 are mounted to the top most plate of metal that forms compactor flange 82 as seen best by reference to FIG. 5. Each tooth 86, which is formed from metal, is pivotally mounted to between two spaced tabs 88 that extend downwardly from the underside of the top most plate of the flange 82. A bolt 90, which extends through complementary openings in the tooth 86 and tabs 88 pivotally holds the tooth in position, (teeth and tab openings not illustrated.) The teeth 86 are formed so as to extend diagonally forward from the associated tabs 88. Teeth 86 are further formed so that the normally horizontally-aligned base of each tooth is located approximately 6 inches below the top of the ram 40 when the ram is extended into the container 42. Each bolt 90 is positioned relative to the associate tooth 86 and tabs 88 so that the tooth can pivot forwardly from its static position but not rearwardly. Owing to the placement of the teeth 86 on the flange 86, the teeth are located inwardly of container opening 57, inside the container 42.

Figure 6:
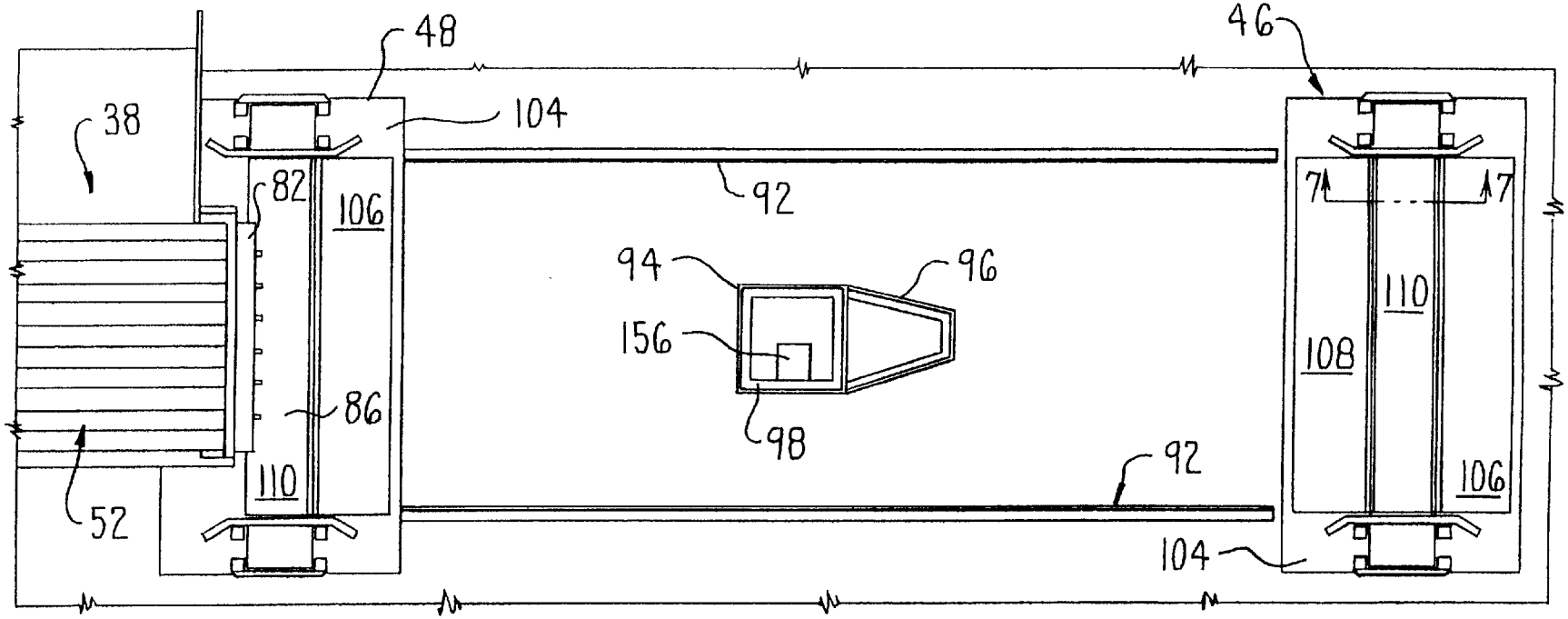
FIG. 6 is a top plan view depicting the scales of this invention.

Scales 46 and 48 are now initially described by reference to FIGS. 6 and 7. The scales are positioned so that, when the container 42 is coupled to the compactor 38, the front wheels 44 rest on front scale 46 and the rear wheels 44 rest on rear scale 48. More particularly, rear scale 48 is located adjacent to compactor 38 and front scale 46 is located forward of the compactor. The scales 46 and 48 are extend over the ground surface over which the container is seated as will be discussed hereinafter. Two U-shaped elongated rails 92 extend between the front and rear scales 46 and 48, respectively, and are secured to the ground surface to which the scales are secured. The rail 92 serves as a guides for the container wheels 44. The scale assembly of this invention also includes a metal guide frame 94 secured to the ground between the scales 46 and 48. Guide frame 94 has a front portion 96 which has a cross sectional profile of a truncated triangle. The apex, the narrow end, of guide frame front portion 94 is directed towards the front scale 46. Guide frame 94 has a base 98 that is integral with and located immediately behind the front portion 96. Base 98 has a rectangular cross-sectional profile. Two parallel spaced apart bars 102 (FIG. 10) extend from the bottom of the container 42 along the length of the container. When the container 42 is backed towards the compactor 38, initially, it is positioned so that the wheels 44 are positioned in the channels defined by rails 92. As the container 42 is backed up more, if it is not precisely aligned, the inner surfaces of bars 102 strike the outer surfaces of the guide frame front portion 96. This causes the requisite lateral shift of the container 42. Then, when the container 42 is finally positioned against the compactor 38, the compactor flange 82 precisely seats in the complementary container opening 57.

Each scale 46 and 48 includes an elongated, flat base plate 104. Each base plate 104 forms the basic support structure for the associated scale 46 or 48 and has a length that is greater than the width of the container 42 the scale is intended to weight. The base plates 104 rest on the ground surface on which the container 42 is normally placed. In some preferred versions of the invention, the base plates 104 are bolted to the underlying ground surface to permanently secure the scales 46 and 48 in place.

Two ramps 106 and 108 and a carriage plate 110 are longitudinally disposed along the base plate 104 of front scale 46. The ramps 106 and 108 and the carriage plate 110 are the surfaces over which the wheels 44 of the container 42 travel. Normally, the scales 46 and 48 are constructed so that ramps 106 and 108 and the carriage plates 110 are between 2 and 6 feet longer than the width of containers 42 they are used to weight. In still more preferred versions of the invention, ramps 106 and 108 and carriage plates 110 are between 3 and 5 feet longer than the width of the associated containers 42. In some preferred versions of the invention, ramps 106 and 108 and carriage plates 110 are approximately 14 feet long. Both ramps 106 and 108 are securely welded to the underlying base plate 104. A first one of the ramps, ramp 106, is the forward ramp, its outer surface is inclined upwardly towards the rear of the scale 46. Ramp 108 is spaced away from the rear edge of ramp 106 and is inclined downwardly towards the rear of the scale.

Carriage plate 110 is located in the space between the ramps 106 and 108. The carriage plate 110 is suspended above the base plate 104 and is the surface of the scale 46 upon which the container wheels 44 are positioned in order to weight the container 42. Thus, when the system 30 of this invention is assembled, the scales 46 and 48 are positioned so that, when the container 42 is coupled to the compactor 38, the front container wheels 44 are positioned on the carriage plate 110 integral with the front scale 46 and the rear container wheels are positioned on the carriage plate 110 integral with the rear scale 48. In most versions of the invention, the scales 46 and 48 are constructed so that the carriage plates 110 are 18 inches or less above the ground surface on which the scales rest. In preferred versions of the invention, the carriage plates 110 are 12 inches or less above the ground surface. In still more preferred versions of the invention, the carriage plates 110 are inches or less off the ground surface. In even more preferred versions of the invention, the carriage plates are 6 inches or less off the ground surface.

Figure 7:
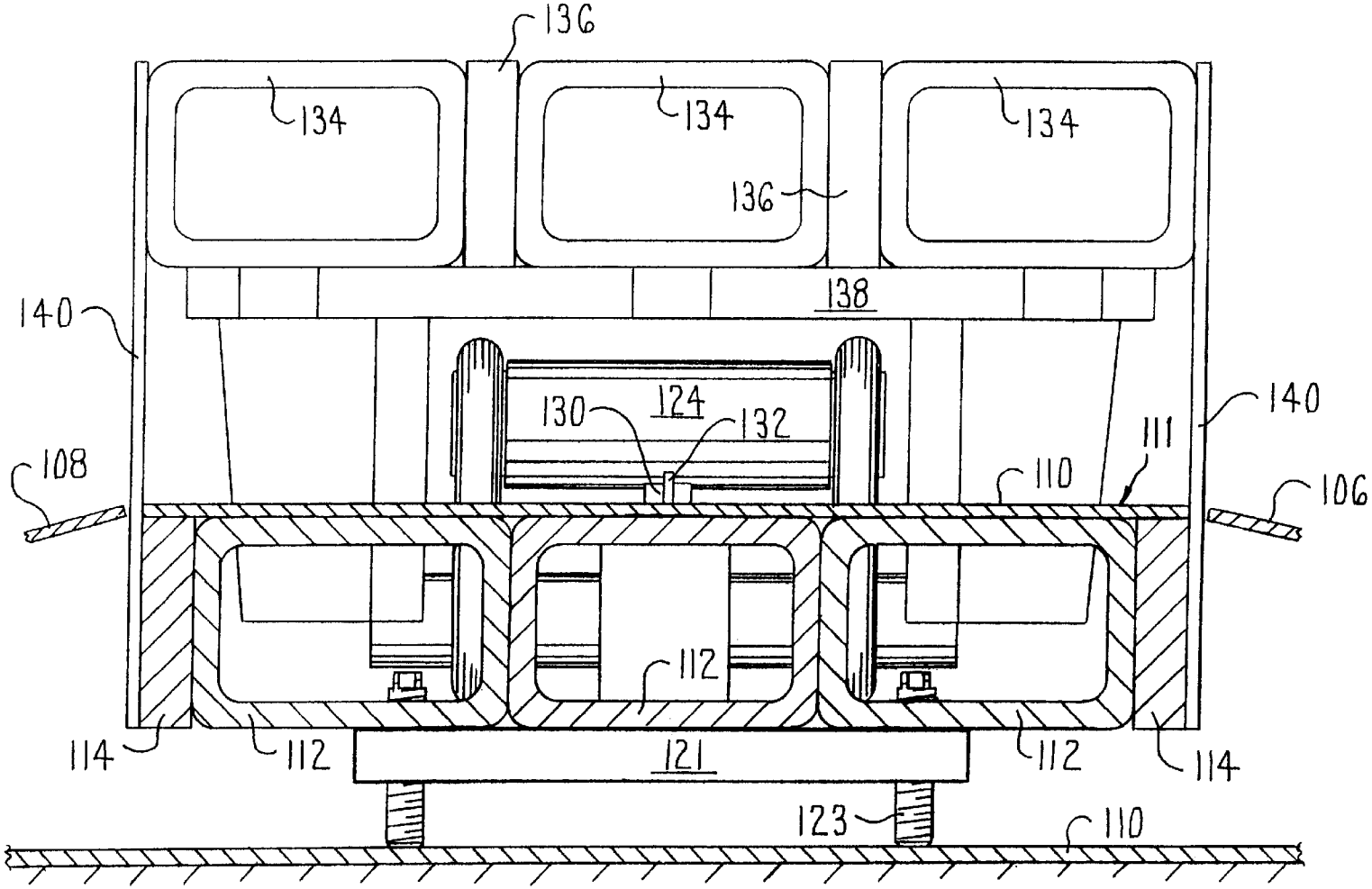
FIG. 7 is a cross sectional view of a carriage plate assembly taken along line 7—7 of FIG. 6. In this view the cover plate of the adjacent load cell assembly is removed so the components of the load cell assembly are visible.
Figure 9:
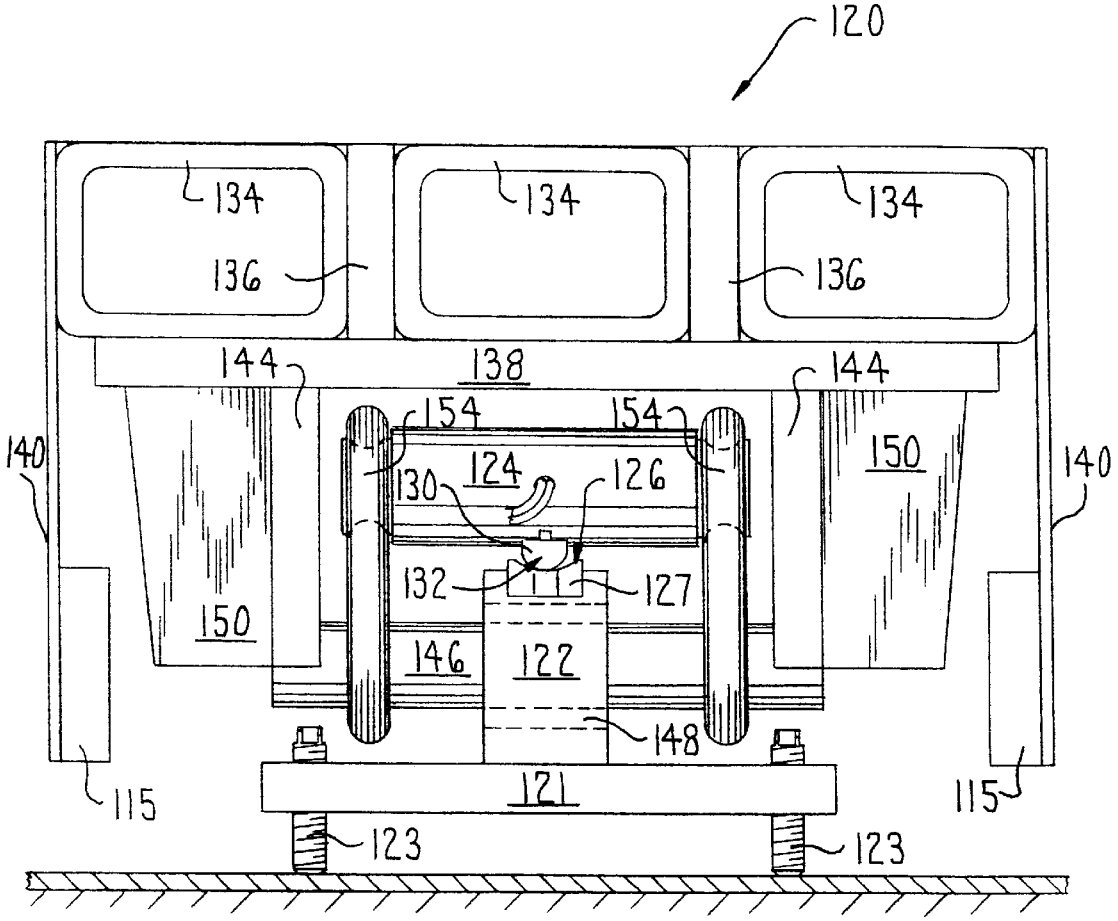
FIG. 9 is a side view of one end of a load cell assembly, the end being open to depict the components forming the scale.

As seen best in FIG. 7, the carriage plate 110 is actual the exposed component of a carriage plate assembly 111. Carriage assembly 111 also includes three support beams 112 that are located under the carriage plate 110 that provide structure support for the carriage plate. Support beams 112 are formed from 6 inch tube steel. Opposed elongated metal bars 114 are welded to the exposed side surfaces of the outer two support beams 112. Bars 114 are formed from 1 inch flat steel. Each bar 114 is dimensioned to have two exposed sections 115, seen in FIG. 9, that project beyond the adjacent ends of the associated carriage plate 110 and support beams 112. As described below, the bars 114 serve as the members of the carriage plate assembly 111 that suspend the assembly above the underlying base plate 104. The support bars 114 are attached to load cell assemblies 120 located at the opposed ends of the carriage plate assembly 111 and that are now described by reference to FIGS. 7 and 9. Each load cell assembly 120 includes a support plate 121 that is disposed over the associated end of the scale base plate 104. In the depicted version of the invention, bolts 123 that hold the base plate 104 in position also secure the support plate 121 in place. In some versions of the invention, at least a portion of the support plate 121 is located above the base plate 104 so that the whole of support plate is horizontally level. A post 122 extends upwardly from the center of the support plate 104.

A weight-measuring load cell 124 is disposed above and mounted to the post 122. More particularly, the post 122 is formed so that the top end is shaped to have an elongated groove 126. In the depicted version of the invention groove 126 is formed in a block 127 that extends upwardly from the top end of the load cell 124. The load cell 124 has a body 128 formed with a tab 130 having a semicircular profile. The load cell 124 is positioned so that tab 130 seats in groove 126. The radius of the post groove 126 is greater than the radius of the load cell tab 130. Consequently, the load cell 124 is able to pivot relative to the post 122. Small studs 132 are fitted to the block 127 and extend upwardly into the space defined by groove 126. Studs 132 are located adjacent the opposed sides of the load cell 124 and prevent the load cell from laterally-shifting position on the post 122. It will further be observed that, owing to its elevated position, the load cell 124 is at least partially located above the carriage plate 110. In one particular version of the invention the Model No. RL72040 load-measuring transducer manufactured by Rice Lake Manufacturing of Rice Lake, Wis. is employed as the load cell 124.

Three load bearing support members 134, shortened versions of beams 112, are parallel aligned and located above the load cell 124 of each load cell assembly 120. Two bars 136, shortened versions of support bars 114, are also provided. Each bar 136 is located between each adjacent pair of support members 134. A horizontally oriented load transfer plate 138 is welded or otherwise permanently secured to the undersurface of support members 134 and bars 136. A side plate 140 is permanently welded to and extends downwardly from the exposed outer sides of the opposed support members 134. The exposed end sections 115 of support bars 114 are welded to the lower portion of the inner surfaces of side plates 140.

Two pairs of legs 144, one pair associated with each load cell assembly 120, support the carriage plate assembly 111 above the base plate 104. Each pair of legs 144 extends downwardly from the load transfer plate 138 with which the legs are associated. The legs 144 have lateral axes that are aligned with and symmetrically located around the longitudinal axis of the carriage plate assembly 111. The opposed ends of legs 144 bear against the opposed ends of a solid, cylindrical load transfer rod 146. To facilitate the seating of legs 144 on rod 146, the bottom ends of the legs are formed with semi-circular grooves, (not illustrated). Rod 146 fits into the grooves. The load transfer rod 146 extends horizontally through a bore 148 (shown in phantom) formed in post 122. Bore 148 is dimensioned so that there is no contact between the surface of the load transfer rod 146 and post 122. Thus, the load placed on rod 146 is not directly transferred from the rod 146 to the post 122. It will further be noted that two reinforcing members 150 extend downwardly from the load transfer plate 138. Each reinforcing member 150 is positioned to abut and is located perpendicularly to a separate one of the legs 144. Reinforcing members 150 provide structural support for the legs 144.

Two closed metal links 152 connect the load transfer rod 146 to the load cell 124. Each link 152 has one end that extends around a section of the load transfer rod 146 adjacent where one of the legs 144 presses against the rod. Each link 152 has a second end that is fitted around a cylindrical, load receiving transducer 154 (shown in phantom) integral with the load cell 130. Thus, at each end of the carriage assembly 111, a fraction of the weight of anything resting on the carriage assembly is transferred through support bars 114, the side plates 140 and the load transfer plates 138 to the legs 144. The legs 144, which are moved downwardly by this force, urge the load transfer rod 146 in the same direction. The downward displacement of the load transfer rod 146 urges links 152 downwardly. The links 152, in turn, impose downward force on the load receiving transducers 154 of the load cell 124. The load cell 124 then generates a signal representative of the force, the weight, to which it has been exposed. Since the load cells 124 are pivotally seated on the associated posts 122, the carriage assembly 111, which is suspended between the load cells, pivots. When the container wheels 44 roll across the carriage plates 110, the carriage assemblies 111 are subjected to asymmetric loading. As a result of these asymmetric forces, the carriage assemblies 111 in turn, pivot. The signals generated by the four load cells 124, two load cells are provided with each scale 46 and 48, are supplied to a transducer signal producer 156. The transducer signal processor 156 is mounted in the base 98 of guide frame 94. (Electrical connections between load cells 124 and processor 156 not shown.) The transducer signal processor 156 adds the signals from the individual load cells 130 to provide a single output signal representative of the weight of the container 42 and the material disposed in it.

Figure 8:
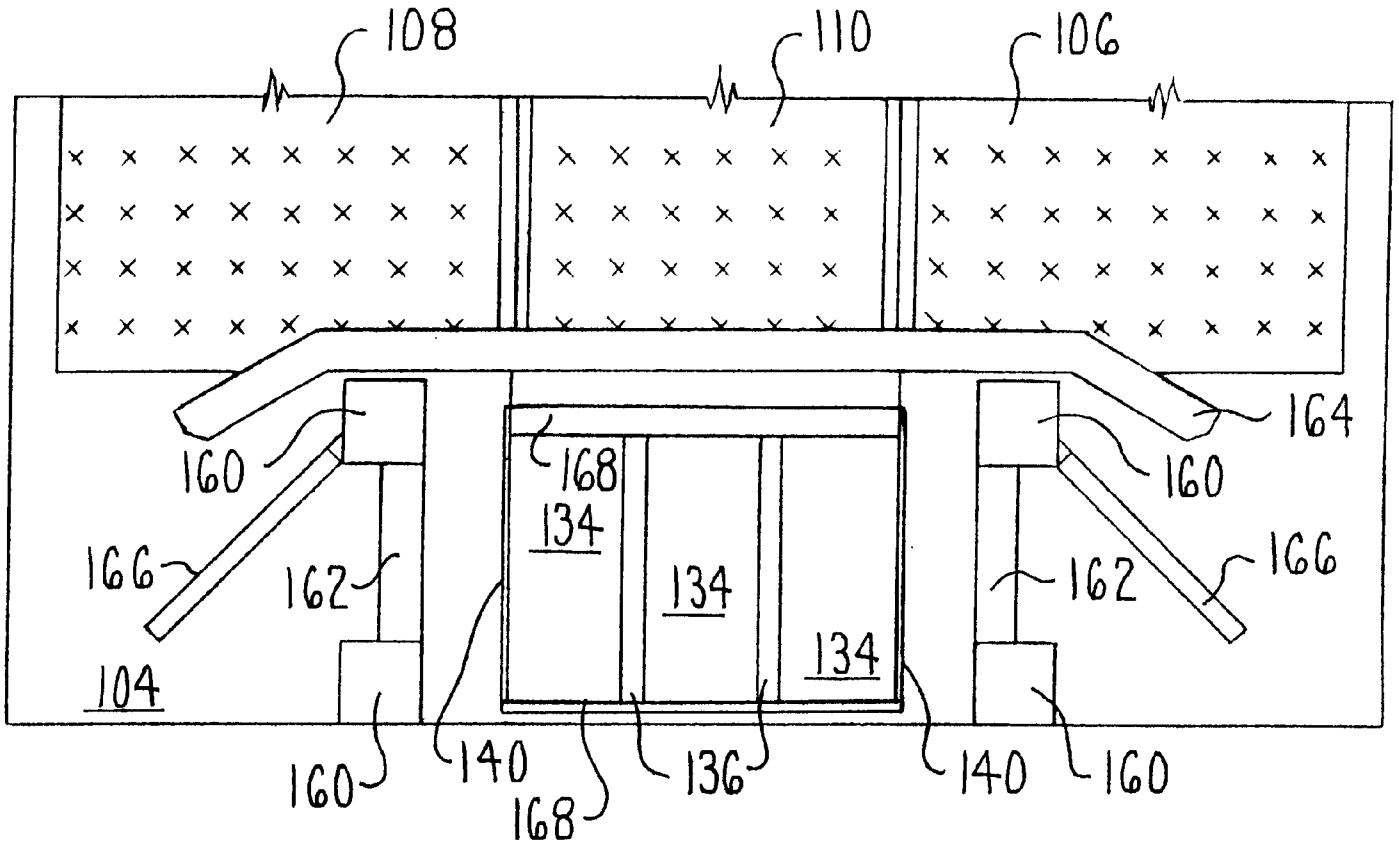
FIG. 8 is a cross sectional view of the ramp and carriage of single one of the scales.

From FIG. 8 it is observed that four posts 160 extend upwardly from the base plate 104 around the corners of the load cell assembly 120. Guard rails 162 extend between the two front most posts, 160 and the two rearwardly positioned posts. Still another guard rail 164 extends between, the two posts 160 located adjacent the ramps 106 and 108 and carriage plate 110. Guard rail 164 extends a slight distance over the ramps 106 and 108 and the carriage plate 110 and beyond the posts 160 to which it is mounted. A brace 166 extends diagonally between the top of each of the two posts 160 located adjacent the ramps 106 and 108 and the base plate 104. Collectively, posts 160, guard rails 162 and 164 and brace 166 substantially surround the load cell assembly 120 to prevent the assembly from being damaged due to a container 42 or other object bumping into the assembly. Cover plates 168 extend between the side plates 140 of the load cell assemblies 120 to protect the components internal to these assemblies.

Rear scale 48 has substantially the same construction as front scale 46. However, since the rear wheels 44 of the container do not travel rearwardly of the carriage plate 110 integral with the rear scale 48, the rear scale is not provided with a rearwardly directed ramp 108. Also, in some versions of the invention, the guard rail 164 that extends over the ramp 106 and carriage plate 110 is attached to an inner face wall 170 of the load cell assembly 120. Thus, when the load cell assembly pivots owing to the pivoting of the carriage assembly 111, the associated guard rails 164 engage in a like pivoting motion.

Container 42 of the system 30 of this invention is now described by reference to FIGS. 1 and 10–12. The container 42 includes a front panel 174, two opposed side panels 176, a bottom panel 178 and a top panel 180. It will be observed that rectangular ports 182 are formed in the front panel 174 and in portions of the side panels 176 adjacent the front panel 174. Metal grates 184 cover the ports 182 to prevent material in the container 42 from coming out of the container through the ports. The side panels 176 are further provided with supplemental through holes 186. In FIG. 1, one of the holes 186 is shown being covered by a plug 188 that is threadedly screwed into the hole.

The side panels 176 are provided with spaced apart, vertically oriented strengthening ribs 190. Ribs 190 extend from the top to the bottom of the associated front and side panels 174 and 176, respectively. A set of aligned, horizontally oriented strengthening ribs 192 are mounted to the side panels 176 between ribs 190. A second set of horizontally oriented strengthening ribs 194 extend across the top panel of the container.

Figure 11:
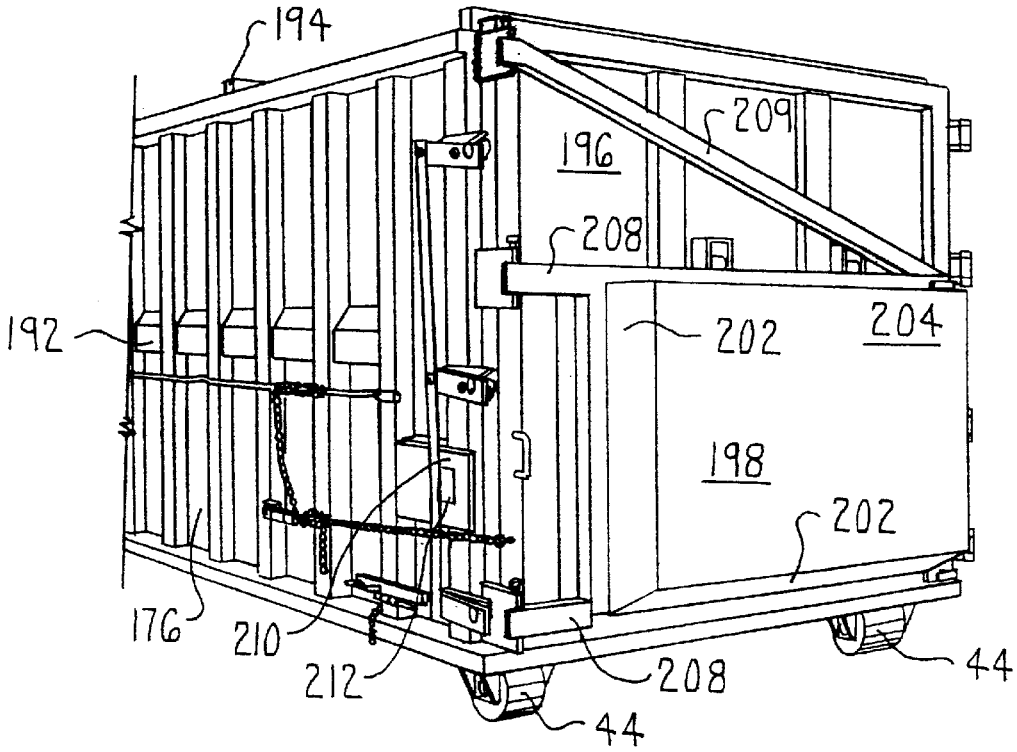
FIG. 11 is a perspective view of the rear of the container.

A back panel 196, seen best in FIG. 11, forms the rear of the container 42. The back panel 196 extends from bottom panel 178 to top panel 180 and is hingedly secured to an adjacent strengthening rib 190 at the rear end of one of the side panels 176. The back panel 196 is formed to define the opening 57 in the rear of the container 42. A shell member 198 is pivotally attached to the back panel 196 selectively covers opening 57.

Shell member 198, includes frame walls 202 that extend rearwardly relative to back panel 196 and that are arranged rectangularly. The shell member 198 further has a base plate 204 that extends between the frame walls 202. Thus, when the shell member 198 is closed, it defines a space, not identified, that extends rearwardly from the opening 57. Shell member 198 is attached to back panel 196 by upper and lower arms horizontally extending arms 208. Arms 208 are pivotally attached to the side of the back panel 196 opposite the side of the panel that is hinged to one of the side walls 176. A third, diagonally extending arm 209 also connects the shell member 198 to the container 42. Arm 209 is hingedly connected at one end to the end of the back panel 196 along the axis along which arms 208 are connected to the back panel. The opposed end of arm 209 is connected to the far end of the shell member 209, the end opposite the end to which arms 208 are connected. Arm 209 serves as a cantilever member to reduce the downward load on the end of shell member 198 that is spaced from arm 208.

Each container side panel 176 is provided with a coupling plate 210 adjacent the rear end of the container 42. Each coupling plate 210 extends between the two most rearward ribs 190. Each coupling plate 210 is formed with an opening 212. When the container 42 is mated to the compactor 38, hooks that are connected by turnbuckles to the compactor are fitted in coupling plate openings 212 (hooks and turnbuckles not illustrated). A tension is placed on the hooks so that the hooks hold the container 42 to the compactor 38.

Container 42 is further shaped so as to have a tapered profile. Specifically, the front ends of the bottom panel 178 and top panel 180 are shorter in width than their complementary rear ends. For example in one version of the invention in which the overall length of the container is 38 feet, it is anticipated that the distance between the side panels 176 at the front of the container will be 96 inches and the distance between the side panels 176 at the rear end of the container will be 102 inches.

Figure 12:
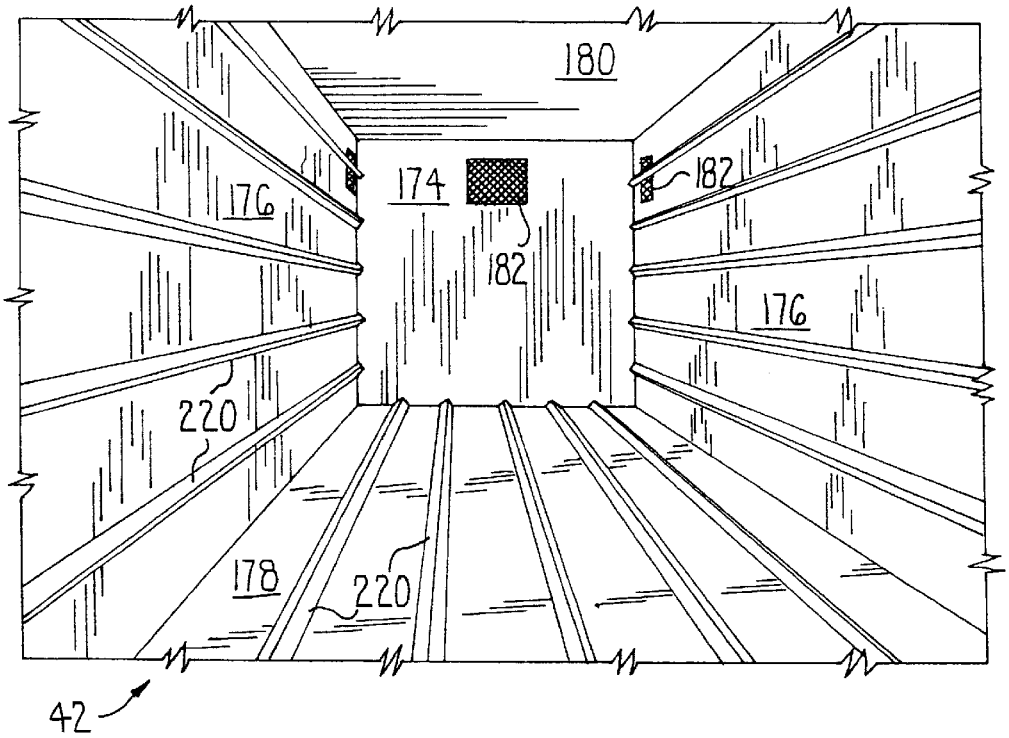
FIG. 12 depicts the inside of a container.

As seen by reference to FIG. 12, spacing ribs 220 are provided inside container 42 along the inner surfaces of side panels 176 and bottom panel 178. In the depicted version of the invention, ribs 220 have a triangular cross sectional profile and are mounted to the surfaces to which they are associated so that apexes are spaced distal from the surfaces. Spacing ribs 220 are spaced apart from each other. In some versions of the invention, the spacing ribs 220 are shaped to be between 3 inches wide at their bases and extend 2 inches above the surface to which they are mounted. The ribs are spaced so that the distance from centerline-to-centerline of adjacent ribs is between 12 and 24 inches. In preferred versions of the invention, the distance between the centerlines of adjacent ribs is 19.5 inches.

Figure 13:
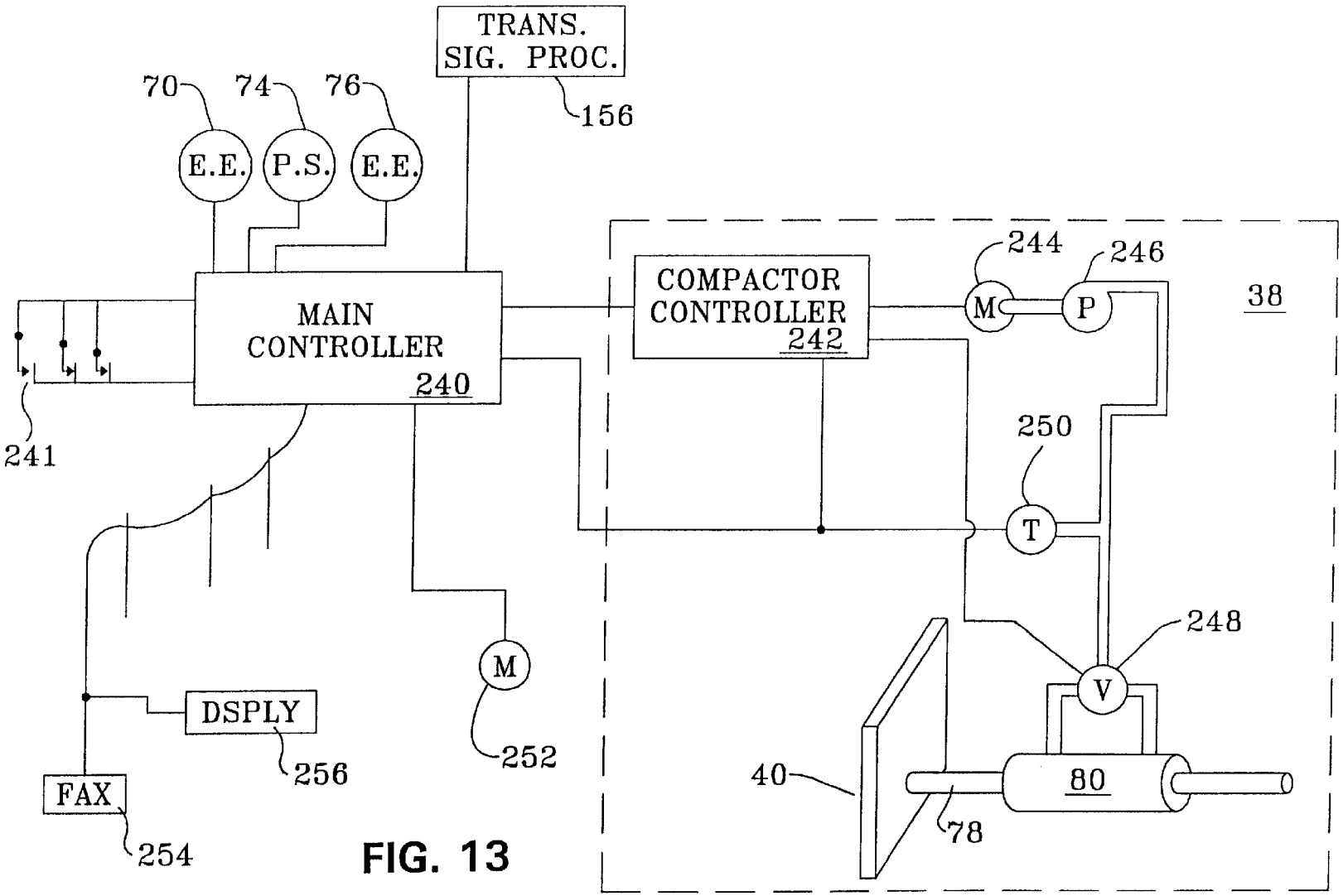
FIG. 13 is a block diagram of the active, state monitoring and control components of the system of this invention.

FIG. 13 depicts in block diagram form the active components, the state monitoring components and the control components of the system 30 of this invention. The system 30 of this invention also includes a main controller 240. The main controller 240 receives as input signals the signal generated by electric eye units 70 and 76 and photosensor 74. Controller 240 also receives as an input the signal from transducer signal processor 156 representative of the gross weight of the container 42. Based on these input signals, controller 240 generates command signals to a compactor controller 242 integral with the compactor 38 to regulate the actuation of the compactor 38. In one version of the invention the progamable logic controller General Electric Model No. 9030 is employed as the main controller 240.

Integral with main controller 240 is a memory, (not illustrated). The memory stores the instructions that control the operation of the main controller 240. The memory also includes data fields in which data obtained during the operation of the system 30 are stored. These data include the gross weight of the container 42 and, at times, counts of the scrap metal pieces discharged into the charge chamber 52. These data are employed by the main controller 240 to regulate the execution of the processing steps performed by the system 30.

The compactor controller 242 actuates the compactor 38 to cause the extension and retraction of the ram 40. Specifically, compactor controller 242, which is internal to the compactor 38, controls the energization of a motor 244 which actuates a pump 246 that pressurizes the hydraulic fluid that actuates the ram 40. The compactor controller 242 also controls a set of valves internal to the compactor, represented by valve 248, which regulates the flow of the fluid into and out of the cylinder 80 to cause the extension and retraction of the ram 40.

It will further be observed that the compactor 38 includes a pressure transducer 250. Transducer 250 is connected to lines through which the hydraulic fluid flows and generates a signal representative of the pressure of the hydraulic fluid. The signal generated by transducer 250 is applied to the compactor controller 242 and used by the controller 242 for purposes not relevant to this invention. The signal generated by transducer 250 is also applied to the main controller 240 for purposes described below.

Main controller 240 also regulates the actuation of a motor 252 mounted to the overhead chute 36 through which the waste is delivered to the compactor 38. Motor 252 controls the setting of the damper plate 37 mounted to the chute to regulate to which one of the adjacent compactors 38 the waste is delivered. Main controller 240 also transmits information about the state of the compactor 38 and container 42 to a remote location. A modem and fax generator are contained internal to the main controller 240 (modem and fax 20 generator not illustrated). These components allow the main controller 240 to transmit information of the public telephone network to a remote facsimile machine 254 or a display unit (computer) 256. Also, if the main controller 240 detects a fault in the system 30, the main controller may be configured to dial up a paging system so as to cause a page to be broadcast with information identifying the malfunctioning system. This would alert a service technician that the system requires attention.

Normally, the system 30 is regulated automatically by the main controller 240. Nevertheless, the compactor is provided with a set of on-site switches 241 that allow manual operation of the system.

The system 30 of this invention is initially configured for use by coupling the container 42 to the compactor 38. In the process of backing the container 42 in place, the hauler initially positions the container between the two load cell assemblies 120 of the front scale 46. In the event the container 42 is improperly aligned with the scale 46, posts 160 and rails 162 and 164 prevent the load cell assemblies 120 from being run over. As the container 42 moves beyond the front scale rear ramp 108, the container rails 102 extend over the guide frame front portion 96. Since the guide frame 94 is securely fixed to the underlying ground surface, the frame displaces the container rails 102 so as to align the container with the compactor 38. Thus, when the container 42 is backed against the compactor 38, compactor flange 82 is seated in the outer perimeter of the container opening 57. Also, once the container 42 is so positioned, the container front wheels 44 are seated on the carriage plate 110 of the front scale 46 and the rear wheels 44 are seated on the carriage plate 110 of rear scale 48. The container 42 is then securely mated to the compactor 38. Once the compactor 38 and container 42 are mated, the system 30 is ready for use. Once the system 30 is ready for use, main controller 240 determines the empty weight of the container 42. This determination is made by evaluating the magnitude of the output signal produced by the transducer signal processor 156. Once this determination is made, this value is stored in a dedicated data field within the memory integral with the main controller 240. This determination is necessary because as the container 42 is fills with scrap, the output signal from transducer signal processor represents the combined weight of the container and the scrap metal contained in it. Throughout the subsequent operation of the system 30, main controller 240 will subtract the stored empty weight value for the container from combined weight to determine the weight of the scrap metal in the container 38.

Scrap metal is delivered to the compactor charge chamber 52 from the chute 36 through hopper 60. Normally, the ram 40 is an a retracted state, spaced away from the charge chamber 52. The charge chamber 52 fills with scrap metal. Initially, when the container 42 is lightly filled, there is less than 30,000 pounds of scrap metal in the container, the charge chamber 52 is allowed to be completed filled prior to the actuation of the compactor 38. This is because when the container 42 is in the initial, lightly filled state, there is essentially no compaction of the initial volumes of scrap metal forced into the container 42. Thus, to reduce wear on the compactor 38, the usage of the compactor is, in this container state, held to a minimum.

Figure 14:
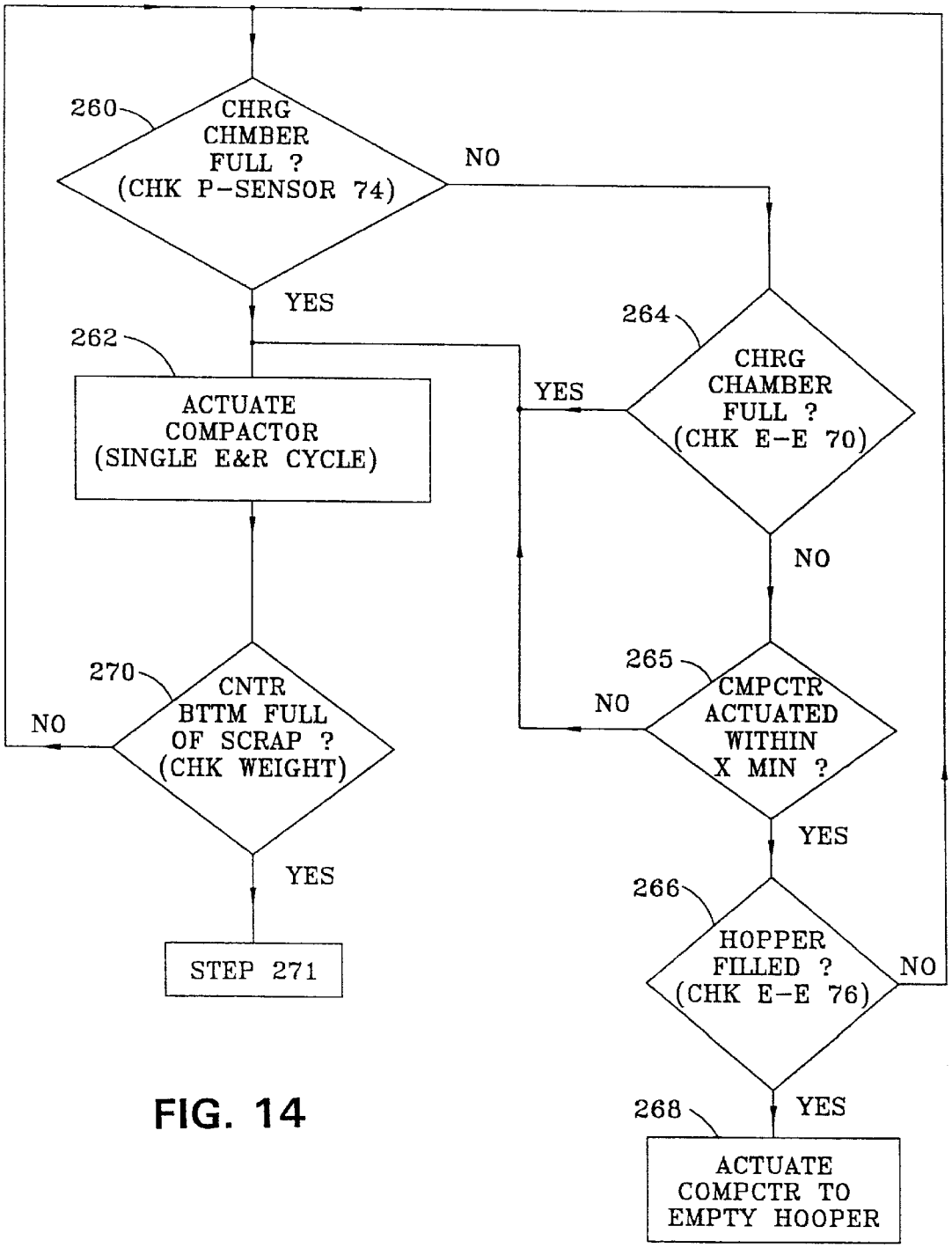
FIG. 14 is a flow diagram of the processing steps executed by the main controller of the system when the container is initially being filled with scrap metal.

Accordingly, when the container 42 is in this initial, lightly filled state, main controller 240 periodically monitors the signal from photosensor 74. As represented by step 260 of FIG. 14, main controller 240 checks this signal to determine whether or not the charge chamber 52 has filled with scrap metal. If the chamber 52 is filled, the beam transmitted by complementary light beam unit 72 is blocked and not received by the photosensor 74. Accordingly, in step 260, main controller determines whether or not photosensor 240 has stopped receiving the light beam and if it has, if the period in which the beam has been broken is for a period of time longer than it takes for a piece of falling scrap metal to break the beam. This period is approximately 15 milliseconds. If the light beam has been broken for a time greater than the above period, the main controller 240 interprets this condition as meaning the compactor is in the charge chamber full state. If the main controller 240 makes this determination, the controller 240 proceeds to actuate the compactor 38, step 262.

In step 262, the main controller 240 issues actuation signals to the compactor controller 242. The compactor controller 242, upon receipt of these actuation signals, energizes motor 244 and sets valve 248 in order to cause the extension and retraction of the ram 40. In preferred versions of the invention, when the compactor 38 and ram 40 are actuated, the front face of the ram 40 extends at least 24 inches into the container 42. In more preferred version of the invention the front face of the ram 40 is extended at least 26 inches into the container. In other preferred versions of the invention, the ram is extended at least 32 inches into the container 42. In even more preferred versions of the invention, the ram 40 extends between 36 and 42 inches into the container 42 through opening 57.

In step 262, main controller 240 generates an actuation signal so as cause the ram 40 to only cycle through a single compression cycle, a single extension and retraction cycle. This is because, as long as the container bottom panel 178 is not fully covered with scrap metal, the extension of the ram 40 simply pushes the scrap metal already in the container forward.

Little, if any, scrap metal "boils over" around and above the ram 40 during this step. ("Boiling over" is the movement of the scrap metal over the top of the ram 40 as the pushes forward against the scrap metal.) Consequently, during the immediately following retraction of the ram 40, the scrap metal does not interfere with this rearward movement.

If, in step 260, the signal from the photosensor 74, indicates that the charge chamber 52 is not filled, main controller 240 monitors the state of the signal generated by the electric eye 70 as represented by step 264. In step 264, the main controller 240 evaluates the signal generated by the downwardly oriented electric eye 70. Specifically, in step 264 the main controller 240 determines whether or not, as indicated by the change in single from electric eye 70, the charge chamber 52 is filled with scrap. More specifically, the signal from electric eye 70 is evaluated to determine whether or not the distance measurement it represents indicates that the charge chamber 52 is filled with scrap metal. If the signal from electric eye 70 indicates the charge chamber is filled with scrap metal, main controller proceeds to execute step 262.

If, in step 264 it is determined the charge chamber 52 is not filled with scrap metal, main controller 240 executes step 265. In step 265, the main controller 240 determines if a set period of time has elapsed since the compactor 38 was last actuated. This determination is made by reviewing the elapsed time on the a timer internal to the controller. This time period, typically a minimum of 2 minutes, varies as function of the discharge of scrap metal from the facility 32 at which the system 30 is installed. If, in step 264 it is determined that the elapsed time since the last actuation of the compactor 38 is greater than the set period, main controller 240 executes step 262. The actuation of the compactor 38 performed as a result of the evaluations of step 264 or of step 265 is a fail-safe. This actuation prevents the charge chamber 52 from being excessively filled with scrap in the event light beam unit 72 and/or photosensor 74 fail.

Main controller 240 also monitors the state of the signal produced by horizontally directed electric eye 76 as a final fail-safe. Specifically, as represented by step 266, the main controller monitors the signal from eye 76 in order to determine whether or not the scrap has fill the charge chamber 52 and is now filling the hopper 60. This monitoring is performed by determining whether or not the signal from eye 76 indicates that its beam length has been shorted and has remained in the shorted state for an extended period of time. The time variable is evaluated in order to compensate for when the beam is temporarily broken by scrap metal falling into the compactor chamber 52.

If, in step 266, indicates the beam has been broken 35 for an extended period of time, main controller 240 actuates the compactor and ram in step 268. As part of step 268, while not depicted in FIG. 14, main controller 240 continues to monitor the level of scrap in the compactor chamber 52 and the hopper 60. The main controller may actuate the compactor 38 and ram 40 a number of times to empty the charge chamber 52 and hopper 60 of scrap. If the main controller 240 determines that the scrap is not emptying from the compactor 38 into the container, the main controller 240 will then recognize this condition as being a fault state. The main controller 240 causes an appropriate message to be broadcast to the dispatcher's office or the service technician. In versions of the invention in which there are two side-by-side compactors 38, the main controller also actuates motor 252 to shift damper plate 37. The shifting of the damper plate 37 causes the scrap to flow to the second compactor 38 which should be properly functioning.

It should be understood that, throughout the operation of the system 30, main controller 240 continually performs the evaluation of step 266. Similarly the clearing of the hopper and the evaluation of whether or not the system 30 may be in a fault state may likewise be performed at any time. Thus, these steps form the ongoing final monitoring of the system 30 to determine whether or not it is properly operating.

If in step 266 it is determined that the system is properly functioning, main controller 240 reexcutes step 260.

Over time, the repeated forcing of waste into the container 42 pushes the waste material towards the front of the container. It is believed that because air is able to vent out through ports 182 in the side of the container 42, that the development high pressure air pockets in the front of the container during the compression process is substantially eliminated. The elimination of these air pockets, allows the waste to stack up, in the container as it is compressed. However, the spacing ribs 220 prevent the mass of compressed waste from pressing against the adjacent inner surfaces of the container 42. The significance of this separation between the waste and container is discussed below.

After each actuation of the compactor 38 and ram 40, the execution of step 262, main controller 240 performs additional processing steps. One step, not illustrated, is the zeroing out of the timer that is evaluated in step 265 to determine whether or not the time since the compactor 38 was last actuated exceeds the set fail-safe time period. As represented by step 270, the main controller 240 also determines whether or not the scrap metal pushed into the container 42 has essentially covered the bottom panel 178. This determination is made by evaluating the weight of the scrap metal in the container 42. (The weight data acquisition steps integral with this determination and the other weight-based evaluations are not depicted.) In some versions of the invention, if the container is 38 feet in length it is assumed that if there is at least 30,000 pounds of scrap metal in the container, that bottom panel 178 is covered with scrap metal.

Figure 15:
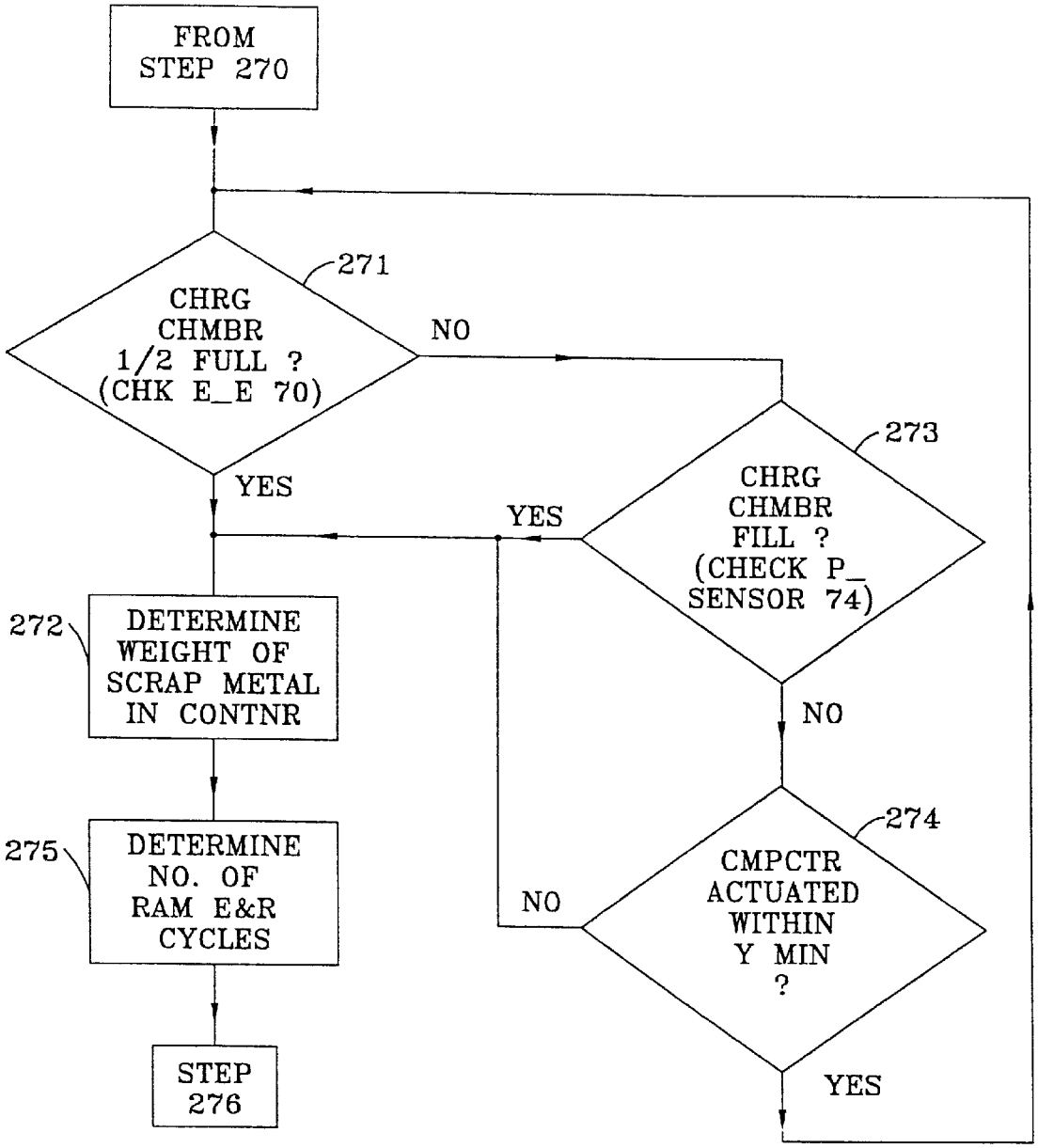
FIG. 15 is a flow diagram of the processing steps executed by the main controller after the container is partially filled with scrap metal in order to determine when the compactor should be actuated.

If it is determined that the bottom panel 178 of the container 42 is not covered with scrap metal, it is assumed that when the compactor 38 and ram 40 are actuated that there is minimal, if any, compression of the scrap metal. Accordingly, the main controller proceeds to reexcute step 260 described above. As discussed above, eventually container 42 starts to fill with scrap and scrap covers the bottom pane, 178 of the container. Once this occurs, any subsequent loading of the scrap from the compactor chamber into the container 42 by ram 40 will result in the compression of the scrap. If, in step 270, it is determined that the container bottom panel 178 is covered with scrap, main processor executes step 271, depicted in FIG. 15, to determine when the compactor 38 and ram 40 should be actuated.

In step 271, main controller 240 determines when the charge chamber 52 is half full of scrap metal. This determination is made based on the distance measurement signal produced by electric eye 70. If, in step 271, the main controller 240 determines that the charge chamber 52 is at least half full of scrap metal, the main controller proceeds to a process in which the scrap metal in the charge chamber 52 is forced into the container 42 and the scrap metal in the container is compressed. This process, described below, begins with a determination of the weight of scrap metal in the container, step 272.

It the signal from electric eye indicates that the charge chamber 52 is less than half full, the main controller 240 proceeds to a first fail-safe test, step 273. In step 273 the main controller 240, based on the state of the signal from photosensor 74, determines whether or not the charge chamber 240 is completely full. The evaluation made in step 272 is the type of evaluation made in previously described step 260. If, in step 273, it is determined that the charge chamber 52 is full, the main controller proceeds to step 272 to initiate the scrap metal feed and compaction processes.

If, in step 273, the main controller 240 determines that the charge chamber 52 is not filled with scrap metal, the main controller 240 proceeds to execute a second fail-safe test, step 274. In step 274, the main controller 240 determines how long it has been since the compactor was last cycled through an actuation. Step 274 is similar in form to previously described step 265. One difference between steps 265 and 274 is that the elapsed time period between successive actuation of the compactor 38 is set to be less for step 274 than for step 265. This difference is because, once the container 42 has reached a certain fill state, less scrap should be forced into it during each actuation of the compactor 38. The reason for this difference is discussed below.

If, in step 274, it is determined that the elapsed time since the last actuation of the compactor is greater than the set time period, main controller 240 initiates the compactor actuation process. If the elapsed time is less than the set time period, main controller 240 returns to execute step 271. It should however, be recognized that, while not depicted in FIG. 15 or any other Figures, the main controller continually executes step 266. Thus, the main controller 240 continually monitors the signal from electric eye 76 to determine whether or not scrap metal has overflowed the charge chamber 52 and started to fill the hopper 60. If this determination is positive, step 268 may be executed. Also, any other of fault recovery/fault announcement steps may be executed in order to either clear the charge chamber 52 and/or broadcast information that the compactor 38 appears to be malfunctioning.

As mentioned above, once the container bottom panel 178 is covered with scrap metal and it is determined that charge chamber 52 is half-full, the compactor actuation process is started. This process begins with step 272 in which the main controller 240 again determines the weight of the scrap metal in the container 52. Once this determination is made, main controller 240, based on the weight of the scrap metal in the container 42, determines how many times extension and retraction cycles the ram 40 should be run through in the during the compactor actuation process. This determination is made in step 275. For example in the version of the invention in which the container is 38 feet long, if, from step 272, if the weight of the scrap metal is under 50,000 pounds, the main controller 240 determines that the actuation of the compactor should consist of 2 successive ram extension and retraction cycles. If the weight of the scrap metal is at or above the above level, main controller 240 determines that the compactor actuation process should consist of 4 successive ram extension and retraction cycles.

Figure 16:
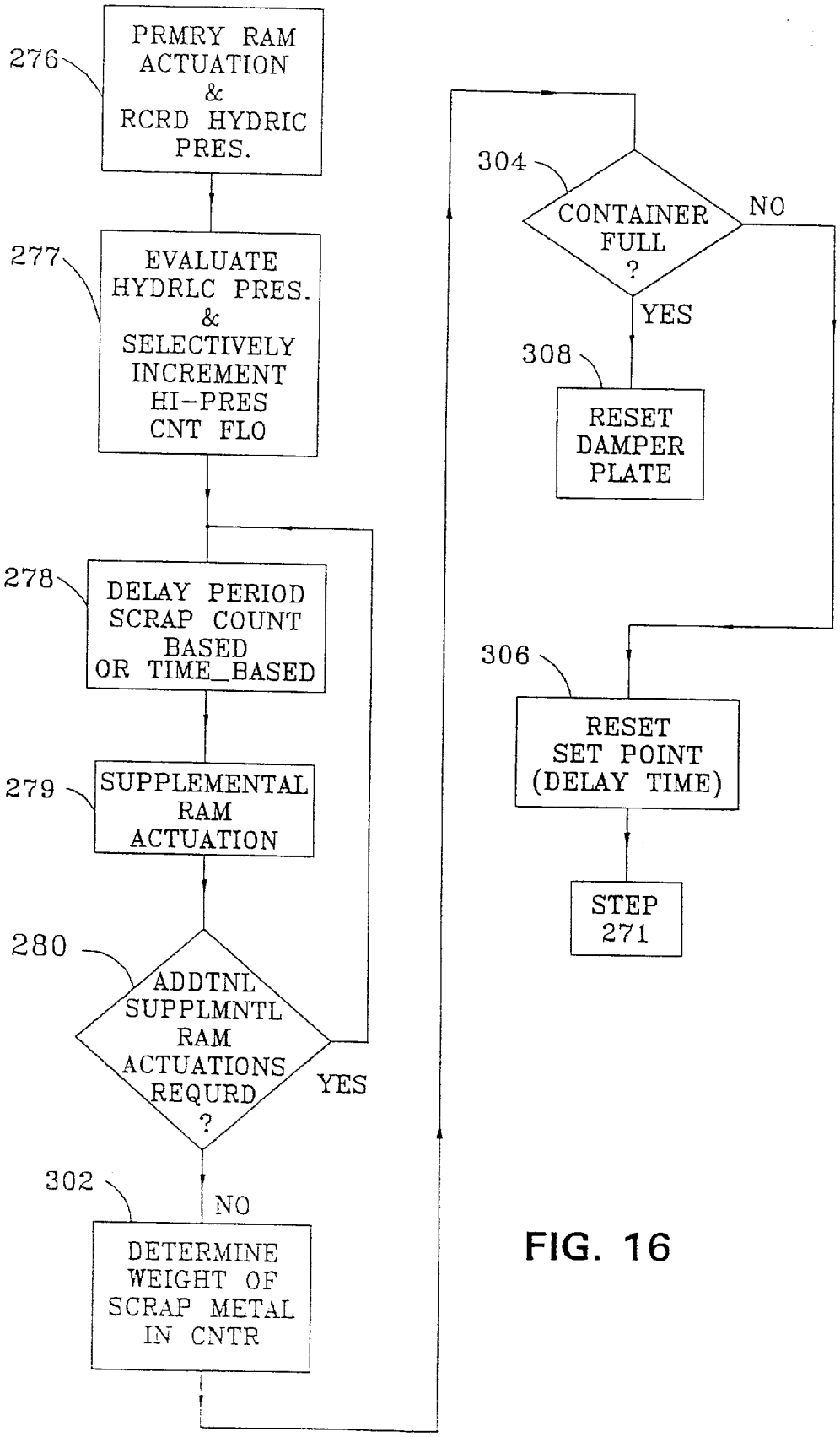
FIG. 16 is a flow diagram of the processing steps executed by the main controller after the container is partially filled with scrap metal in order to force additional scrap metal into the container and to compress the scrap metal into the container.
Figure 18:
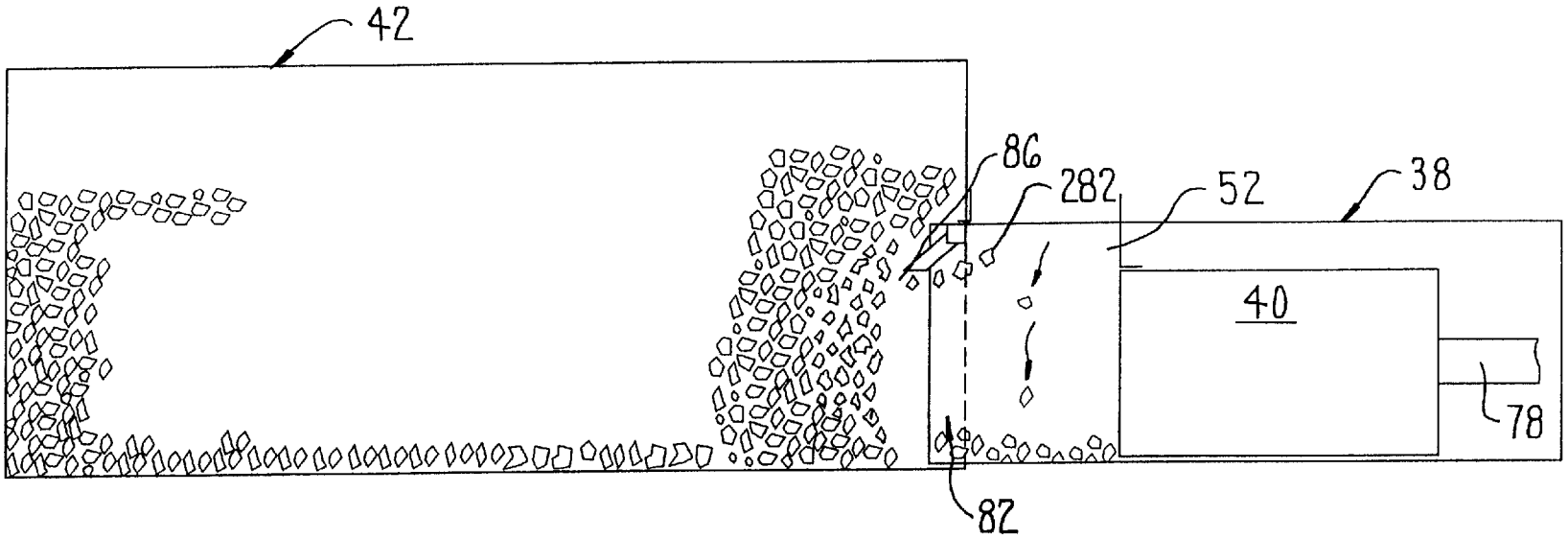
FIG. 18 is a view inside the container in which the state of the scrap metal immediately after a primary extension and retraction of the ram is depicted.

After step 275 is comuleted, main controller 240 engages in a step 276 depicted in FIG. 16. In step 276, the main controller 240 generates actuation signals to the compactor controller 242 to cycle the ram through a primary extension and retraction cycle. As a result of this initial actuation of the ram 40, the scrap metal in the charge chamber 52 is forced into the container 42. This newly added scrap metal and the scrap metal already in the container is compressed.

Integral with step 276, the pressure of the hydraulic fluid employed to actuate the ram is monitored. More particularly, the main controller 240 determines the highest pressure required to extend the ram. This determination is made by monitoring the signal generated by pressure transducer 250.

Main controller 240, in a step 277, then evaluates they hydraulic pressure data obtained in step 276. In step 276 the main controller determines if the highest hydraulic pressure measured in step 276 is above a select value. In some versions of the invention, this value is between 2600 and 3100 psi. In some specific versions of the invention, this value is 2850 psi. If the hydraulic pressure was above this value, the main controller increments the value contained in an internal memory high pressure count field. If the hydraulic pressure is below the set value, the main controller 240 zeros the count contained in high pressure count field. Thus, in the high pressure count field, the main controller 240 maintains a count of how many consecutive times the hydraulic pressure in the primary actuation step 276 was above the high pressure set value. The reason these data are stored is discussed below.

Immediately after step 277 is executed, the system enters a delay period as represented by step 278. In some versions of this invention, this delay period is a chronologically defined period. For example, the period may extend from 2 to 6 minutes. In more preferred versions of the invention, the period may be approximately 4 minutes long.

Alternatively, the delay is based on a count of a number of the pieces of scrap metal that are discharged into the charge chamber 52 after the ram 40 has fully retracted from primary actuation step 276. This counting is performed by monitoring the output signals produced by electric eye 70 and photosensor 74. More particularly, the output signals from eye 70 and photosensor 74 are analyzed to determine if they indicate there have short breaks in the light beams these transducers monitor. These breaks occur when falling pieces of scrap metal interrupt the light beams. Typically, it has been found that a falling piece of scrap will interrupt a light beam for between approximately 10 and 15 milliseconds.

Accordingly, during step 278, main controller 240 monitors the output signals produced by electric eye 70 and photosensor 74 to determine if these signals undergo state changes representative of these light breaks. For each transducer 70 and 74, the main controller memory has a count field. Each light beam break representative of a piece of scrap metal intersecting the beam is noted. The cumulative number of these light beam breaks for each sensor is stored in the associated count field.

When a piece of scrap metal is discharged into the charge chamber 52 it will break none, one of or both of the light beams. Statistically, few pieces of scrap fail to break either light beam. Accordingly, during step 278, as the scrap metal falls into the charge chamber 52, the scrap counts maintained in the count fields increase. The main controller 240 periodically evaluates the counts to determine if a specific number of piece of scrap metal have been detected. When the specific scrap metal piece count has been reached for either of the count fields, the delay step 278 is considered completed. Once either the time-based or scrap-count based delay step 278 is completed, the main controller 240 causes the system 30 to execute a supplemental ram actuation step 279. In step 279, the main controller 240 generates the actuation signals to the compactor controller 242 necessary to cause a supplemental extension and retraction cycle of the ram 40. In this supplemental extension and retraction of the ram, the small volume of scrap metal discharged into the charge chamber 52 is pushed into the container 42. The purpose for step 279 is discussed below.

After step 279, the main controller performs a step 280 in which it determines whether or not additional executions of steps 278 and 279 are required. This determination is made by counting the number of times the system has executed step 279 since the immediately preceding primary actuation step 276. The value "1" is added to this count to account for the primary extension and retraction cycle, step 276. The sum of these cycles is then compared to the cycle count for this particular compactor actuation sequence required cycles previously determined in step 275. If the total extension and retraction cycle count is less than the required cycle count, main controller proceeds to reexcute steps 278 and 279.

Figure 17:
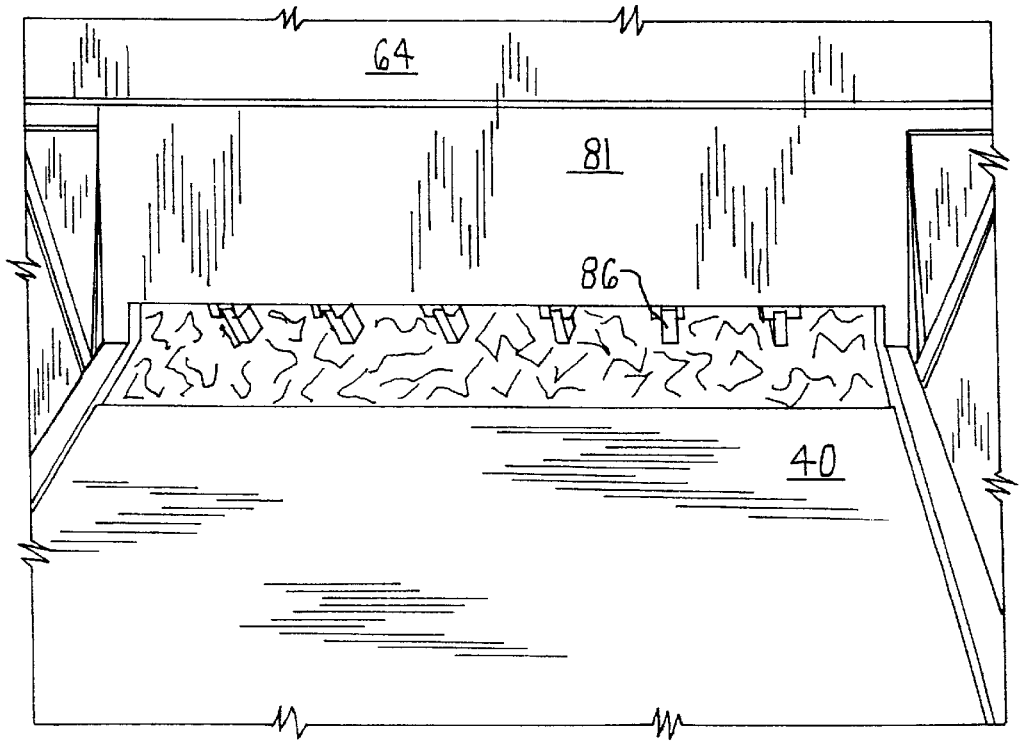
FIG. 17 illustrate how the teeth located at the front end of the compactor prevent scrap metal from being dragged rearwardly with the retraction of the ram.
Figure 19:
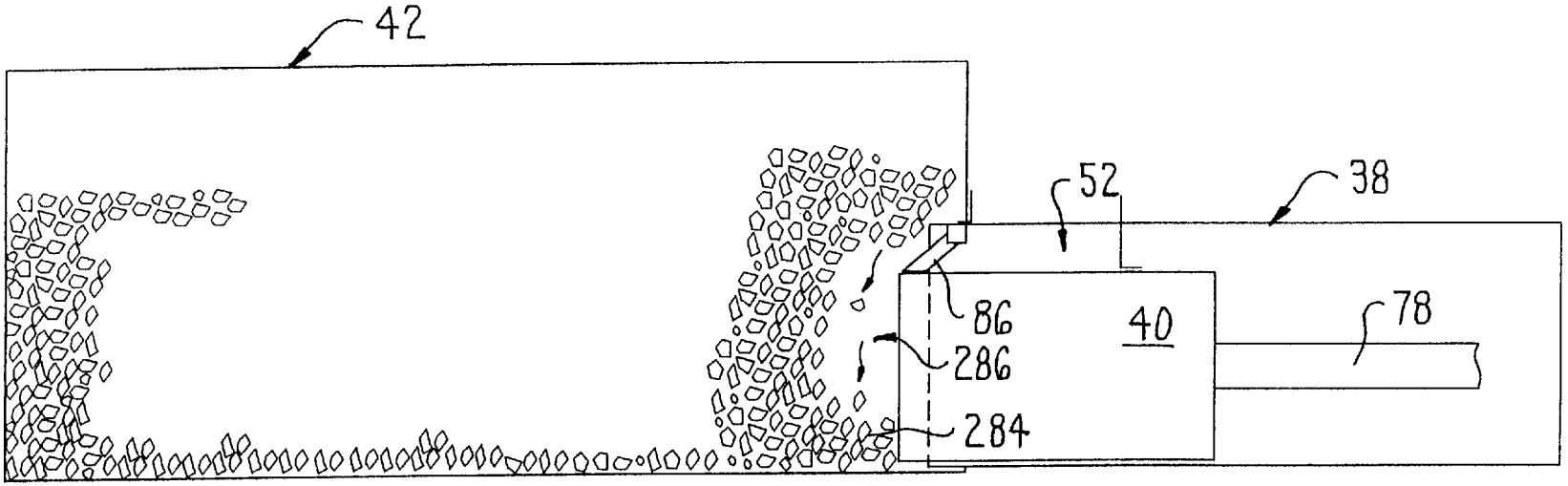
FIG. 19 is a view inside the container in which the state of the scrap metal during a supplemental extension of the ram is depicted.

The reason why the ram 40 is cycled through supplemental extension and retraction cycles once the container bottom panel 178 is covered with scrap metal is now described by reference to FIGS. 17–20. As discussed above with respect to step 271, the system is configured so that, when step 276 is actuated, the charge chamber 52 is only half-filled with scrap metal. Thus, in comparison to the amount of scrap metal forced into the container when step 262 is performed, in step 276, only a relatively small amount of scrap metal is forced into the container. However, some of this scrap metal may still boil over and be pushed above the top of the front face of the ram 40. A portion of this scrap metal may rest on top of the ram 40. As the ram 40 is retracted, this scrap metal becomes entrained in the teeth 86 mounted to the forward end of the compactor 38 as seen in FIG. 17 and 19. The teeth 86 thus limit the extent to which the scrap metal is dragged backwardly on top of the ram. The limitation of this movement minimizes the extent to which the scrap catches between the ram and the adjacent compactor flange 82 so as to wedge between these two components.

Nevertheless, a head 282 of scrap metal forms around teeth 86. This scrap metal head 282 may even extend into the charge chamber 52. During a subsequent cycling of the ram 40, the compactor 38 may have to employ significant amounts of force to clear this head of scrap metal head 281 away from teeth 86. The measurement of the force, the hydraulic pressure readings that are taken during this process are, as expected, relatively high. These high pressure readings are, in turn, interpreted by the main controller 240 as an indication that the container 42 is filled to at or near capacity. Since, most of the time, the container 42 is not so filled, this interpretation is incorrect.

In order to eliminate the likelihood that the removal of the scrap metal head 281 around teeth 86 will result an inaccurate downline determination of container fullness, steps 278 and 279 are executed. As a result of the delay between the primary and supplemental ram actuations, when step 279 is executed, the small volume of scrap metal in the charger chamber 52 is forced into the container. The volume of scrap metal forced into the container 42 in this step 279 is less than one-quarter the volume of the scrap metal pushed into the container in the previously executed primary actuation step 276. This scrap metal, when pushed against the scrap metal already in the container 42, forms a small block of scrap 284 on the bottom panel 178 as seen in FIG. 19. This block of scrap 284 pushes the scrap metal face 282 forward. This action thus cause a small void space 286 to develop immediately in front of the upper face of the ram 40.

Simultaneously with the development of void space 286, the ram 40 pivots the compactor teeth 86 upwardly. Then the ram 40 is retracted. The retraction of the ram 40 releases the compactor teeth 86 to loosen scrap hung up in the teeth that forms head 282. As the ram 40 retracts further, owing to the presence of void space 286, this loosened scrap metal is a able to fall. Thus the execution of the supplemental actuation step 279 clears the scrap around teeth 86 that could potentially form a wedge. Also, as seen by FIG. 20, the execution of step 279, pushes the scrap metal face forward. Collectively, the result of these actions is that a space 288 is formed in the container 42 adjacent opening 57. This space extends from above the small volume of scrap metal resting on the bottom panel 178 adjacent the opening to the area in the container immediately forward of teeth 86.

When the ram 40 is next extended forward in a primary actuation step 276, it will push a volume of scrap approximately equal to one-half the volume of the charge chamber forward. This scrap metal is first forced into the previously formed void space 288. Thus, the extent to which this scrap metal boils over the top of the ram 40 is minimized. The minimization of the boil over substantially eliminates the wedging of the scrap metal against the ram and the resultant blockage of ram movement.

The number of delay and supplemental ram actuation steps 278 and 279, respectively, that are executed are a function of the fullness of the container 42. This is because, as the container 42 is filled, the execution of a single pair of steps 278 and 279 may not be sufficient to cause the desired void space 288 to develop. Accordingly, as described above, once the container is filled to the level at which it is necessary to form void space 288, steps 272 and 275 are executed. These steps 272 and 275, respectively, determine the fullness of the container, based on weight, and based on this evaluation, the number of times steps 278 and 279 need to be executed.

Returning to FIG. 16, in step 280, the main controller 240 eventually determines that the ram 40 engaged in the appropriate number of extension and retraction cycles for the level of container fullness. Once this determination is made, the main controller proceeds to execute step 302 in which it again determines the weight of scrap metal in the container. Then, the main controller 240 determines whether or not the container should be considered to be full of scrap as represented by step 304. The actual algorithm executed in step 304 is discussed below with respect to FIG. 21.

If, in step 304, it is determined that the container 42 is not completely filled, main processor 240 proceeds to a set point adjustment step 306. In step 306, the main processor 240 may adjust, based on the weight of the scrap metal in the container, the set point or set points against which the scrap counts obtained during step 278 is compared. These set points fall as the volume of the scrap metal in the container 40 increases. For example, in some versions of the invention, when the weight of the scrap metal in the container is approximately 30,000 pounds, the container is slightly less than half full, the delay period is considered over when 100 pieces of new scrap metal have been discharged into the charge chamber. When the container 42 is filled with 75,000 pounds or more of 30 scrap, the container is almost filled, the delay period is considered over when only 25 pieces of scrap have fallen into the charge chamber 52. Again, it should be understood that in step 278, main controller 240 monitors the scrap count fields for both electric eye 70 and photosensor 74. When the scrap count field for either of these sensors indicate that the set number of pieces have been discharged into the charge chamber 52, the delay period is considered over.

Alternatively, if the delay step 278 is time-based, in step 306 the time period for the delay period is reset. This period is set to decrease as the volume of scrap metal in the container increases. Once the scrap count set points are adjusted (or the time delay period reset,) the main controller 240 returns to step 271. If, however, in step 304 it is determined that the container is full, the main controller 240 proceeds to step 308. In step 308, motor 252 is actuated to shift damper plate 37. The shifting of the damper plate 37 diverts the scrap to the companion compactor 38 to which an empty container 42 has been mated. Then, the main controller 240, for the new compactor 38, determines when the compactor should be actuated based on charge chamber 52 fullness evaluation discussed with respect to step 260.

Figure 21:
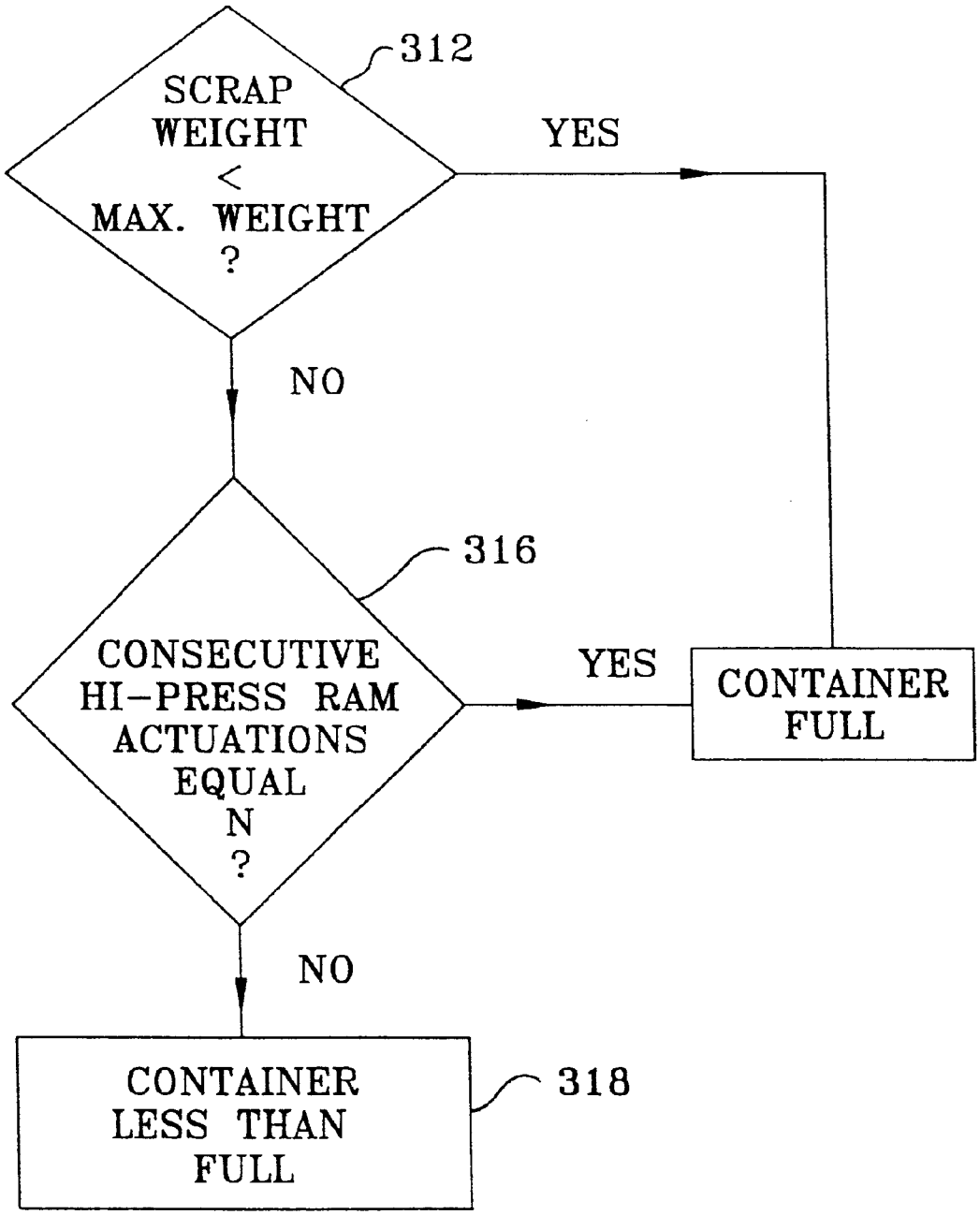
FIG. 21 is a flow diagram of the process steps executed by the system of this invention to evaluate whether or not a container used with the system is full.

The processing steps by which the main controller 240, in step 304, determines whether or not the container 42 is full are now described by reference to FIG. 21. Initially, in a step 312, the main controller 240 compares the weight of scrap in the container 42 to a set level. In some versions of this invention, this weight can be between 75,000 and 85,000 pounds. If the weight of the scrap exceeds a set level, the main controller 240 recognizes this state as being one in which the container 42 is filled to capacity, step 314. This is the positive determination of container fullness of decision step 304.

If, in step 312, the main controller 240 determines the weight of the scrap in the container 42 is below the set weight, the main controller proceeds to execute step 316. In step 316, the main controller 240 makes a container fullness determination based on the hydraulic pressure measured during the primary ram actuations steps 276. These pressures are reviewed to determine whether or not they exceed a set maximum pressure. In one version of this invention, this determination is made by evaluating the data in the high pressure count field the field that maintains the count data obtained in step 277. This data are evaluated to determine if the hydraulic pressure exceeded the maximum set pressure for a select number of consecutive primary ram actuation steps 276. In some versions of the invention this select number is between 5 and 15. In still more preferred versions of the invention, the data in the high pressure count field is evaluated to determine if for the last 10 consecutive primary ram actuation steps, the established hydraulic pressure level was acceded. If the answer to above determination is negative, the main controller recognizes this state as being one in which the container 42 has not yet been filled to capacity, step 318. This is the negative determination of the container 42 being filled to capacity of step 304.

However, if in step 316 it is determined that the hydraulic pressure set maximum value was consistently exceeded, the main controller recognizes this state as being the one in which the container 42 is filled to capacity, step 312. Thus, in the system 30 of this invention, if either a maximum scrap weight or a maximum hydraulic pressure level is reached, it will be assumed that the container 42 is filled to capacity.

It should further be understood that the definition of whether or not a container is filled to capacity may further be a function of whether or not the system 30 with which the container is associated has one or two compactors 38. If the system has two compactors 38, a container may actually be allowed to be completely filled before its is considered filled. This is because in these versions of the system 30, once this determination is made, it is a simple matter to execute step 308 in order to cause the diversion of additional scrap into the second compactor 38 to which a waiting empty container 42 has been attached.

However, in a version of the system 30 with a single compactor-and-container, the container may be considered filled, when it is slightly less than completely filled. In this version of the system 30, once the main controller determines in step 304 that the container has reached a certain fullness, in the subsequent step 296 it then forwards this information to the hauler's dispatcher. This early warning of container fullness provides the hauler with sufficient time to schedule the removal of the container and its replacement with an empty container before the container becomes overfilled.

When a full container 42 of this invention arrives at site where it is to be unloaded, the back panel 196 is opened. The container 42 is inclined so that front end is higher than the rear end. Owing to the gap between the compressed scrap and the container caused by the spacing ribs 220, the presence of ports 182 and 184, and its tapered profile, when the container is in this state, air is able to flow around the scrap in the container. Consequently, gravity provides sufficient force to urge the compressed scrap out of the container 42. Once the container 42 is completely emptied, it is returned to its normal horizontal orientation and is again available to be filled with scrap.

The compactor 38 of the system 30 of this invention is provided with teeth that eliminate the wedging of scrap between the compactor ram 40 and the adjacent surface of the container. Wedging of scrap metal is further eliminated by the plural extensions and retractions of the compactor ram 40 during the compression cycles when the container 42 is filled. The multiple extensions and retractions of the ram 40 also break up the scrap metal head 282 that can form around teeth 86. The breaking up of this head 282 eliminates the potential for false indications that the container 42 is full.

The container 42 is able to hold very large loads of waste. The container 42 is also designed so that even when this waste is compacted in the container, gravity is still able to provide sufficient force to unload the container. Also, the scales 46 and 48 are collectively able to provide accurate measure of the gross weight of the container so that the fullness of the container can be constantly monitored. Collectively, these features make it possible so that the system 30 of this invention, including a container having a length of 38 feet, a height of 8 feet, and a rear width of 102 inches, can store and compress at least 60,000 pounds of scrap metal in the container. More particularly, the system with the above-described container 42 can hold at least 75,000 pounds of scrap metal and often up to 85,000 pounds of scrap metal.

Still another feature of the system of this invention is that scales 46 and 48 are located on the ground surface on which the complementary container would normally rest. Thus, the scales of this invention are themselves relatively economical to install. Also, when the container is placed upon the scale, its height is only raised by the elevation of the scale carriage plates 110. Since the carriage plates 110 are not significantly above the underlying ground surface, the container is not significantly raised above the ground surface. Thus, the installation of these scale 46 and 48 does not significantly dislocate the position of the containers they are used to weight. The installation of the scales does not require the facility 32 at which this system 30 is installed to reposition the complementary equipment used to deliver waste to the system.

Moreover, each scale 46 or 48 of this invention can be exposed to and accurately weigh loads of up to 100,000 pounds. In preferred versions of the invention, each scale 46 or 48 can be exposed to and accurately weight up to 125,000 pounds. In still more preferred versions of this invention, each scale 46 or 48 can weight up loads up to 150,000 pounds. In the most preferred versions of this invention, each scale 46 or 48 can weight up to 200,000 pounds. In practice, it is difficult to know exactly which portion of a container 42 and its load will be located on the front scale 46 and which portion will be located on the rear scale 48. Therefore, the above load limits are also the recommended load limits for when the scales 46 and 48 are employed together in tandem to measure the gross weight of a container 42 and its load. Nevertheless, it should be understood that the above described preferred versions of scales 46 and 48 of this invention are used together to continually monitor the weight of an empty container 42 placed on them and the scrap metal that is compressed into the container.

The container 42 of this system is designed so that, when waste material is forced in the container, air is vented from the container through ports 182. This prevents high pressure air pockets from developing which can block the movement of waste into sections of space within the container. Consequently, substantially all of the interior space within the contain 42 of this invention can be filled with scrap metal. When the container 42 is first moved away from the compactor 38, a small amount of waste material may extend out of container opening 57. This material is covered by the shell member 198 when the shell member is closed over the opening 57.

Also, owing to the ports 182 and 186 and spacing ribs 220, air flows in the interstitial space between the interior walls of the container and the compressed scrap metal. Due to the tapered profile of the container, as the compressed scrap metal in the forward section of the container starts to move forward, the gap between the 30 waste and the side walls of the container increases. This further increases the volume of free moving air that surrounds the compressed scrap metal in the container 42. Consequently, when the container 42 is inclined, gravity provides sufficient force to force the waste scrap out of the container. Thus, the container 42 of this system, even though it is designed to transport compressed scrap metal, is not provided with a moving, waste ejecting front panel. Since the container 42 does not include this panel and the complementary hydraulic drive unit, it is more economically manufactured than containers with these components. Moreover, the elimination of this moving panel eliminates the increase in empty weight the panel and its associated drive unit add to other container. The elimination of this weight increases the useful load that the container 42 can transport.

Another feature of this invention is that the main controller 240 determines whether or not the complementary container 42 is full based on either the weight of the container or the pressure employed to compress scrap metal in the container. Thus, in the event the type of scrap delivered to the system varies, the system does not evaluate fullness based on a parameter that does not correlate to the fullness level of the container 42. More particularly, when relatively heavy and hard to compress scrap metal such as steel is delivered to the system, weight alone provides a reasonable measure of container fullness. However, in the event lighter weight metal such as aluminum scrap is provided to the system, gross container weight may not provide an accurate measure of container fullness. Instead, the hydraulic pressure employed to actuate the ram 40 provides a measure of whether or not the container is full. More particularly it should be understood that at the container 42 is filled the pressure required to push the ram 40 forward to compress the waste increases. Thus, if light weight metal is delivered to the system 30, the fullness determination based on hydraulic pressure provides a fail-safe indication of whether or not the container 42 can accept additional waste.

It should be recognized that the foregoing is directed to one specific version of the invention and that other versions of the invention can vary from what has been described. For example, while the compactor 38, the container 42 and the scales 46 and 48 have been described as an integrated system 30, clearly, these assemblies can be used separate from each other when required or desired.

Moreover, in some versions of the invention, it may be desirable to bolt a set of T-shaped or L-shaped rails to the surface to which the scales 46 and 48. Each rail has an elevated surface that extends between the carriage plate of the front scale 46 to the carriage plate 110 of the rear scale 48. To accommodate the positioning of the rails, the scales 46 and 48 are provided with base plates 104 that are formed with notches. The notches define the space adjacent the carriage plates where the rails are mounted. The presence of the rails eliminates the need to provide the front scale with a rear ramp and the rear scale with a front ramp. An advantage of this construction of the invention is that once the container is rolled up on the forward most carriage plate, it travels in an elevated state onto the complementary carriage plate 110 integral with the rear scale. This eliminates the need to have to roll the rear end of the container down the back end of the front scale and back up against the front end of the rear scale 48.

Also, in some versions of the invention, it may desirable to mount the front scale 46 onto parallel, fixed moving tracks. These tracks would extend forward from the rear scale 48. This version of the invention allows the position of the front scale 46 to be set relative to the rear scale 48. This version of the invention is installed at locations at which the length of the containers 42 with which the system is used varies.

Moreover, it should be understood that the disclosed components from which different elements of the invention are constructed are for purposes of example only and are not meant to be limiting. For example, photosensor 76 may be replaced by a light beam unit and photosensor similar to unit 72 and sensor 76. Different sensors than the disclosed electric eyes and photosensor may be used to monitor fullness of the charge chamber 52. For example, in some versions of the invention, sonic sensors may be employed to monitor the volume of scrap metal in the charge chamber 52. Alternatively, load transducers could be used to monitor the weight of the scrap metal supplied to the charge chamber 52. The amount of this weight it should be understood is proportional to the fullness of the charge chamber 52. Furthermore in some versions of the invention, the main controller and compactor controller can be integrated into a single unit. In these versions of the invention, a single processor: determines when the compactor 38 needs to be actuated; determines the number of extension and retraction cycles through which the ram 40 is cycled during the compactor actuation; controls the setting of the components internal to the compactor 38 necessary to cause the actuation of the ram 40; determines the fullness of the container 42; and causes the requisite data about the state of the compactor and container to be broadcast.

Moreover, it may be necessary to provide small raised ribs similar to speed bumps in the ground surface around the system 30. These raised ribs are necessary because often the scrap metal received by the system 30 is coated with an oil. This oil was applied to the scrap metal to facilitate the metal shaping process. If the scrap metal is covered with this oil, the compression of the scrap metal forces the oil out of the container 42. The raised ribs prevents the uncontrolled flow of this oil away from the system. If this oil is present, the ribs facilitate its collection for recycling and further use.

Also, it should be recognized that the above described process steps represent a single sequence of steps for performing the method of this invention. Clearly the process steps can be performed in sequences different than described. For example, in some versions of the invention, the determination of container fullness based on hydraulic pressure may be based on a single pressure reading of the fluid used to actuate the ram. Alternatively this determination of container fullness may be based on an average of the pressure readings obtained during plural actuations of the ram. Also it should be clear that the weight determination of the scrap metal in the container obtained in one step 302 of the process may be the weight employed as the input variable in the subsequent ram cycle determination step 275. This method eliminates the need to conduct the weight determination step 272. Also, in some versions of the invention, steps identical to or similar to steps 265 and 274 may not be executed. Thus, in these versions of the invention, the compactor 38 is only actuated when the associated sensors indicate that the charge chamber 52 is a requisite state of fullness.

Moreover, evaluations of container fullness in order to determine whether or not the scrap metal covers the entire bottom panel of the container, the number of times the ram should be extended and retracted in actuation cycle and/or the delay set point or delay set time, may be based on a variable other than just the weight of the scrap metal in the container. In other versions of the invention, these intermediate determinations of container fullness, the volume of scrap metal in the container, may be based on compactor hydraulic pressure. Alternatively, these fullness/volume determinations may be based wholly or in part on the number of times the ram is actuated to clear the charge chamber 52. Also, these determinations of container fullness may be based on two input variables, for example, both the weight of the scrap metal and the hydraulic pressure required to actuate the ram.

Also, in some versions of the invention, the primary determination of when to actuate the ram 40 may not be based on measurements of the volume of scrap metal in the charge chamber 52. In some versions of the invention, this determination may be made based on counts of the pieces of scrap metal that are discharged into the charge chamber 52.

Furthermore, the components from which the sub-assemblies of this system are formed may vary from what has been described.

Moreover, while the system 30 is described as specifically being useful for compressing and transporting scrap metal, it should be recognized that its utility is not that limited. This system 30 as a whole, or any one of the sub-assemblies from which it is formed, may be used as or incorporated into other systems 20 designed for compressing, storing and transport material, including waste material other than the described scrap metal.

Therefore, it is the object of the appended claims to cover all such modifications and variations that come within the true spirit and scope of this invention.

What is claimed is:

1. An assembly for forcing material into and compressing material in a container, said assembly including:

a scale assembly, said scale assembly having at least one load-receiving member for removably receiving a container and at least one transducer connected to said load-receiving member for generating a weight signal representative of the weight on said load receiving member;

a compactor, said compactor including:

a housing, said housing having a charge chamber into which material is delivered, an open end contiguous with said charge chamber wherein said housing is positioned so that an opening in the container is in registration with the open end of said housing;

a chamber fullness sensor assembly attached to said housing to monitor the amount of material in the charge chamber, wherein said chamber fullness sensor assembly generates a chamber fullness signal representative of the amount of material in the charge chamber; and a ram assembly including a moveable ram mounted to said housing, said ram positioned to translate through the charge chamber to push material into the container wherein, said ram assembly, in response to receipt of a ram actuation signal, actuates said ram; and a processor connected to said scale assembly to receive the weight signal and to said compactor to receive the chamber fullness signal and to generate to said ram assembly the ram actuation signal and said processor is configured so that:

said processor determines whether or not the fullness of the container is below or at or above a first fullness level based on the weight of the container and the material in the container as indicated by the weight signal;

when the container is below the first fullness level, said processor generates the ram actuation signal when said chamber fullness signal indicates there is a first amount of material in the charge chamber; and when the container is at or above the first fullness level, said processor generates the ram actuation signal when said chamber fullness signal indicates that there is a second amount of material in the charge chamber, the second amount of material being less than the first amount of material.

2. The assembly of claim 1 wherein said processor is further configured so that:

when the weight signal indicates that the container is below a second fullness level, said processor generates the ram actuation signal so that, each time said ram is employed to push material into said container, said ram engages in a first specific number of extension/retraction cycles; and when the weight signal indicates that the container is at or above the second fullness level, said processor generates the ram actuation signal so that, each time said ram is employed to push material into said container, said ram engages in a second specific number of extension/retraction cycles, the second specific number of extension/retraction cycles being greater than the first specific number of extension/retraction cycles.

3. The assembly of claim 2, wherein said processor is configured so that the container first fullness level and the container second fullness level are the same level.

4. The assembly of claim 1, wherein said chamber fullness sensor assembly includes:

a first fullness sensor for determining whether or not there is the first amount of material in the charge chamber and said first fullness sensor supplies a first fullness sensor signal to said processor representative of whether or not there is the first amount of material in the charge chamber; and a second fullness sensor for determining whether or not there is the second amount of material in the charge chamber and said second fullness sensor supplies a second fullness sensor signal to said processor representative of whether or not there is the second amount of material in the charge chamber.

5. The assembly of claim 1, wherein said load-receiving member is located above ground level.

6. The assembly of claim 5, wherein said scale is further configured so that said load-receiving member is a maximum of 18 inches above ground level and said scale is configured to weight loads up to a maximum load, the maximum load being at least 125,000 pounds.

7. The assembly of claim 1, wherein said chamber fullness sensor assembly includes at least one sensor configured to make a volumetric measurement of the fullness of the housing charge chamber.

8. The assembly of claim 1, wherein said chamber fullness sensor assembly includes at least one transducer attached to said housing to monitor the weight of the material in said charge chamber.

9. The assembly of claim 1, wherein said chamber fullness sensor assembly includes at least one transducer for monitoring the quantity of material delivered to the housing charge chamber.

10. The assembly of claim 1, wherein said processor is further configured to:

monitor an elapsed time since said processor last generated the ram actuation signal; and if said elapsed time exceeds a set time period, generate said ram actuation signal.

11. The assembly of claim 1, wherein said processor is further configured to:

monitor an elapsed time since said processor last generated the ram actuation signal;

when the container is below the first fullness level and the elapsed time exceeds a first set time period, generate the ram actuation signal; and when the container is at or above the first fullness level and the elapsed time exceeds a second set time period, generate the ram actuation signal wherein, the second set time period is less than the first set time period.

12. An assembly for forcing material into a container, said assembly including:

a compactor, said compactor including:

a housing, said housing having a charge chamber into which material is delivered, an open end contiguous with said charge chamber wherein said housing is positioned so that an opening in a container is in registration with the open end of said housing;

a chamber fullness sensor assembly attached to said housing to monitor the amount of material in the charge chamber, wherein said chamber fullness sensor assembly generates a chamber fullness signal representative of the amount of material in the charge chamber; and a ram assembly including a moveable ram mounted to said housing, said ram positioned to translate through the charge chamber to push material into the container;

a container fullness sensor configured to determine the extent to which the container is full of material and to generates a container fullness signal representative of container fullness; and a processor connected to said compactor to receiver therefrom the chamber fullness signal and to regulate the actuation of said ram, and connected to said container fullness sensor assembly to receive the container fullness signal, said processor being configured to selectively actuate said ram, wherein:

when the container fullness signal indicates that the container fullness is below a first fullness level, said processor actuates said ram when the chamber fullness signal indicates that there is a first amount of material in the charge chamber; and when the container fullness signal indicates that the container fullness is at or above the first fullness level, said processor actuates said ram when the chamber fullness signal indicates that there is a second amount of material in the charge chamber, the second amount of material being less than the first amount.

13. The assembly of claim 12, wherein said processor is further configured so that:

when the container fullness signal indicates that the fullness of the container is below a second fullness level, said processor regulates the actuation of said ram so that, each time said ram is employed to push material into said container, said ram engages in a first specific number of extension/retraction cycles; and when the container fullness signal indicates that the fullness of said container is at or above the second fullness level, said processor regulates the actuation of said ram so that, each time said ram is employed to push material into said container, said ram engages in a second specific number of extension/retraction cycles, the second specific number of extension/retraction cycles being greater than the first specific number of extension/retraction cycles.

14. The assembly of claim 13, wherein said processor is configured so that the container first fullness level and the container second fullness level are the same level.

15. The assembly of claim 12, wherein said chamber fullness sensor assembly includes at least one sensor attached to said housing that is configured to monitor the volume of material in the charge chamber.

16. The assembly of claim 15, wherein said chamber fullness sensor assembly includes:

a first sensor attached to said housing that is configured to determine if there is a first volume of material in the charge chamber; and a second sensor attached to said housing that is separate from said first sensor that is configured to determine if there is a second volume of material in the charge chamber, the second volume being different from the first volume.

17. The assembly of claim 12, wherein said chamber fullness sensor assembly includes a load transducer mounted to said housing to determine the weight of material in the charge chamber.

18. The assembly of claim 12, wherein:

said chamber fullness sensor assembly includes a sensor positioned and configured to monitor the delivery of material to the charge chamber and said sensor generates a material delivered signal when material is delivered to the charge chamber; and said processor receives the material delivered signals from said chamber fullness sensor assembly signal and, based on the material delivered signals, determines the amount of material in the charge chamber.

19. The assembly of claim 12, wherein:

said container fullness sensor is a scale having a load receiving member on which the container is seated and a load transducer connected to said load receiving member to determine the weight disposed on said load, receiving member and that generates a weight signal representative of the weight on said load receiving member; and said processor is connected to said load transducer to receive the weight signal and to determine the fullness level of the container based on the weight of the container and the material in the container.

20. The assembly of claim 19, wherein said load receiving member is located above ground level.

21. The assembly of claim 20, wherein: said load receiving member is located a maximum of 18 inches above ground level; and said scale is configured to weight loads up to a maximum load, the maximum load being at least 125,000 pounds.

22. The assembly of claim 12, wherein:

said ram assembly includes: an actuator configured to displace said ram so that said ram pushes material into the container; and a force sensor connected to said actuator to determine the force employed by said actuator to displace said ram, wherein said force sensor generates a ram force signal representative of the force employed to displace said ram; and said processor receives from said ram assembly the ram force signal and employs the ram force signal as the container fullness signal.

23. The assembly of claim 12, wherein said processor is further configured to:

monitor an elapsed time since said processor last caused said ram to be actuated; and determine if the elapsed time exceeds a set time period, and if the elapsed time exceeds the set time period, to actuate said ram.

24. The assembly of claim 12, wherein said processor is further configured to:

monitor an elapsed time since said processor last caused said ram to be actuated;

when the container fullness is below the first level, determine if the elapsed time exceeds a first set time period, and if the elapsed time exceeds the first set time period, to actuate said ram; and when the container fullness is at or above the first level, determine if the elapsed time exceeds a second set time period, and if the elapsed time exceeds the second set time period, to actuate said ram, wherein the second set time period is less than the first set time period.

25. An assembly for forcing material into and compressing material in a container, said assembly including:

a scale assembly, said scale assembly having at least one load-receiving member for removably receiving a container and at least one transducer connected to said load-receiving member for generating a weight signal representative of the weight on said load receiving member;

a compactor, said compactor including:

a housing, said housing having a charge chamber into which material is delivered, an open end contiguous with said charge chamber wherein said housing is positioned so that an opening in the container is in registration with the open end of said housing; and a ram assembly including a moveable ram mounted to said housing, said ram positioned to translate through the charge chamber to push material into the container; and a processor connected to said scale assembly to receive the weight signal and to said compactor to receive the chamber fullness signal and to said ram assembly to regulate actuation of said ram and said processor is configured so that:

said processor determines whether or not the fullness of the container is below or at or above a select fullness level based on the weight of the container and the material in the container wherein, the select fullness level is below a level at which the container is full;

when the container fullness is below the select fullness level, said processor regulates the actuation of said ram so that, each time said ram is employed to push material into said container, said ram engages in a first specific number of extension/retraction cycles; and when the container fullness is at or above the select fullness level, said processor regulates the actuation of said ram so that, each time said ram is employed to push material into said container, said ram engages in a second specific number of extension/retraction cycles, the second specific number of extension/retraction cycles being greater than the first specific number of extension/retraction cycles.

26. The assembly of claim 25, wherein said chamber fullness sensor assembly includes at least one transducer for monitoring the quantity of material delivered to the charge chamber.

27. The assembly of claim 25, wherein:

a chamber fullness sensor is mounted to said compactor to monitor the amount of material in the charge chamber and said chamber fullness sensor generates a delivery signal representative of the amount of material in the charge chamber; and said processor is connected to said chamber fullness sensor to receive the chamber fullness signal and said processor is configured so that when said processor causes said ram to engage in the second number of extension/retraction cycles, said processor sequences the extension/retraction cycles so that, after each extension/retraction cycle, a subsequent extension/retracting cycles occurs after the chamber fullness signal indicated a select amount of material is in the charge chamber.

28. The assembly of claim 25, wherein said load-receiving member is located above ground level.

29. The assembly of claim 25, wherein said scale assembly is further configured so that said load-receiving member is a maximum of 18 inches above ground level and said scale assembly is configured to weight loads up to a maximum load, the maximum load being at least 125,000 pounds.

30. An assembly for forcing material into a container, said assembly including:

a compactor, said compactor including:

a housing, said housing having a charge chamber into which material is delivered, an open end contiguous with said charge chamber wherein said housing is positioned so that an opening in a container is in registration with the open end of said housing; and a ram assembly including a moveable ram mounted to said housing, said ram positioned to translate through the charge chamber to push material into the container;

a container fullness sensor configured to determine the extent to which the container is full of material and that generates a container fullness signal representative of container fullness; and a processor connected to to actuate said ram and to said container fullness sensor assembly to receive the container fullness signal and, said processor is configured to selectively actuate said ram, wherein:

when the container fullness signal indicates that the container fullness is below a first set level, said processor regulates the actuation of said ram, so that, when said ram is actuated to force material into the container, said ram engages in a first set number of extension/retraction cycles wherein, the first set level of container fullness is below a level at which the container is completely full; and when the container fullness signal indicates that the container fullness is at or above the first set level, said processor regulates the actuation of said ram so that, when said ram is actuated to force material into the container, said ram engages in a second set number of extension/retraction cycles, the second set number of extension/retraction cycles being greater than the first set number of extension/retraction cycles.

31. The assembly of claim 30, wherein:

a chamber fullness sensor is mounted to said compactor to monitor the amount of material in the charge chamber and said chamber fullness sensor generates a chamber fullness signal representative of the amount of material to the charge chamber; and said processor is connected to said chamber fullness sensor to receive the chamber fullness signal and said processor is configured so that when said processor causes said ram to engage in the second set number of extension/retraction cycles, said processor sequences the extension/retraction cycles so that, after each extension/retraction cycle, a subsequent extension/retraction cycles occurs after the chamber fullness signal indicates a select amount of material is in the charge chamber.

32. The assembly of claim 31, wherein said chamber fullness sensor includes at least one transducer for monitoring the quantity of material delivered to the charge chamber.

33. The assembly of claim 30, wherein:

said container fullness sensor is a scale having a load receiving member on which the container is seated and a load transducer connected to said load receiving member to determine the weight disposed on said load receiving member and that generates a weight signal representative of the weight on said load transducer; and said processor is connected to said load transducer to receive the weight signal and to determine the fullness level of the container based on the weight of the container and the material in the container.

34. The assembly of claim 33, wherein said load receiving member is located above ground level.

35. The assembly of claim 34, wherein: said load receiving member is located a maximum of 18 inches above ground level; and said scale is configured to weight loads up to a maximum load, the maximum load being at least 125,000 pounds.

36. The assembly of claim 30, wherein:

said ram assembly includes: an actuator configured to displace said ram so that said ram pushes material into the container; and a force sensor connected to said actuator to determine the force employed by said actuator to displace said ram, wherein said force sensor generates a ram force signal representative of the force employed to displace said ram; and said processor receives from said ram assembly the ram force signal and employs the ram force signal as the container fullness signal.

37. The assembly of claim 30, wherein said processor is further configured to:

monitor an elapsed time since said processor last caused said ram to be actuated;

when the container fullness is below the second set level, determine if the elapsed time exceeds a first set time period, and if the elapsed time exceeds the first set time period, to actuate said ram; and when the container fullness is at or above the second set level, determine if the elapsed time exceeds a second set time period, and if the elapsed time exceeds the second set time period, to actuate said ram, wherein the second set time period is less than the first set time period.

* * * * *